US006851674B2

(12) United States Patent
Pierce et al.

(10) Patent No.: US 6,851,674 B2
(45) **Date of Patent: *Feb. 8, 2005**

(54) PACHINKO STAND-ALONE AND BONUSING GAME WITH DISPLAYED TARGETS

(75) Inventors: Jesse E. Pierce, Las Vegas, NV (US); Olaf Vancura, Las Vegas, NV (US)

(73) Assignee: Mikohn Gaming Corporation, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/809,260

(22) Filed: Mar. 25, 2004

(65) Prior Publication Data

US 2004/0178574 A1 Sep. 16, 2004

Related U.S. Application Data

(63) Continuation-in-part of application No. 10/161,568, filed on Jun. 3, 2002, which is a continuation of application No. 09/632,357, filed on Aug. 3, 2000, now Pat. No. 6,398,219, which is a continuation of application No. 09/442,831, filed on Nov. 17, 1999, now Pat. No. 6,139,013, which is a continuation of application No. 09/098,804, filed on Jun. 17, 1998, now Pat. No. 6,047,963.

(60) Provisional application No. 60/081,724, filed on Apr. 14, 1998.

(51) Int. Cl.[7] ..... A63B 71/00

(52) U.S. Cl. ..... 273/139; 273/138.1; 273/126 A; 273/121 B; 463/20

(58) Field of Search ..... 273/139, 138.1, 273/126; 463/20

(56) References Cited

U.S. PATENT DOCUMENTS

| | | | | |
|---|---|---|---|---|
| 426,546 A | | 4/1890 | Reed | |
| 524,475 A | | 8/1894 | Wheeland | |
| 1,181,027 A | | 4/1916 | Mannhardt | |
| 1,520,345 A | | 12/1924 | Hamilton | |
| 1,947,772 A | * | 2/1934 | Harris | 273/138.3 |
| 2,192,622 A | | 3/1940 | Radtke | |
| 2,614,840 A | | 10/1952 | Monkres | |
| 2,732,210 A | | 1/1956 | Heide | |
| 3,383,111 A | | 5/1968 | Lucas | |
| 3,531,114 A | | 9/1970 | Parks et al. | |
| 3,797,828 A | | 3/1974 | Ishikawa et al. | |
| 3,807,736 A | | 4/1974 | Goldfarb et al. | |
| 3,825,265 A | | 7/1974 | Pitkanen et al. | |
| 3,897,951 A | | 8/1975 | Morrison et al. | |
| 4,055,342 A | * | 10/1977 | Matsumoto | 273/108.32 |
| 4,055,344 A | | 10/1977 | Soucie | |
| 4,508,336 A | | 4/1985 | Yokoi | |

(List continued on next page.)

FOREIGN PATENT DOCUMENTS

| | | |
|---|---|---|
| DE | 2 359 603 | 6/1974 |
| DE | 32 20 395 A1 | 12/1983 |
| EP | 0 189 256 A2 | 7/1986 |
| EP | 0 671 713 A1 | 9/1995 |
| GB | 2 218 558 A | 11/1989 |
| JP | 3-68382 | 3/1991 |
| JP | 4-73076 | 3/1992 |

*Primary Examiner*—Derris H. Banks
*Assistant Examiner*—Dolores R. Collins
(74) *Attorney, Agent, or Firm*—Dorr, Carson, Sloan, Birney & Kramer, P.C.

(57) ABSTRACT

A bonus game for an underlying base casino machine played by a player wherein the bonus game provides a Pachinko playing field, a ball propelled onto the Pachinko playing field when a bonus condition occurs during play of an underlying casino game. The Pachinko playing field having a row of lanes so that the ball, after traversing the playing field, travels through one of the lanes. A display at said row of lanes on said playing field for displaying at the lanes, targets, digits used to form a decimal number, graphic symbols used to perform a mathematical operation, symbols appearing in the underlying game outcome, so as to provide awards, wild symbols, extended game play, etc.

35 Claims, 19 Drawing Sheets

U.S. PATENT DOCUMENTS 4,840,375 A * 6/1989 Lawlor et al. ..... 273/121 A
4,871,171 A 10/1989 Rivero
5,004,238 A 4/1991 Okada
5,016,879 A * 5/1991 Parker et al. ..... 273/126 A
5,120,060 A * 6/1992 Parker et al. ..... 273/138.2
5,131,655 A 7/1992 Ugawa
5,149,095 A 9/1992 Kashimoto et al.
5,241,379 A 8/1993 Tsujita
5,342,049 A 8/1994 Wichinsky et al.
5,393,057 A 2/1995 Marnell, II
5,462,277 A 10/1995 Takemoto
5,494,287 A 2/1996 Manz
5,509,655 A 4/1996 Ugawa
5,516,104 A 5/1996 Takemoto et al.
5,542,669 A 8/1996 Charron et al.
5,603,659 A 2/1997 Okada
5,628,685 A 5/1997 Takemoto et al.
5,636,837 A 6/1997 Takemoto et al.
5,664,775 A 9/1997 Kao
5,707,285 A 1/1998 Place et al.
5,788,230 A 8/1998 Krise et al.
5,845,902 A 12/1998 Takemoto
5,846,902 A 12/1998 Boyles et al.
5,882,261 A * 3/1999 Adams ..... 463/20
6,047,963 A * 4/2000 Pierce et al. ..... 273/121 B
6,139,013 A * 10/2000 Pierce et al. ..... 273/121 B
6,203,008 B1 3/2001 Krise et al.
6,203,009 B1 3/2001 Sines et al.
6,220,593 B1 * 4/2001 Pierce et al. ..... 273/138.1
6,340,158 B2 * 1/2002 Pierce et al. ..... 273/138.1
6,358,146 B1 3/2002 Adams
6,398,218 B1 * 6/2002 Vancura ..... 273/138.1
6,398,219 B1 * 6/2002 Pierce et al. ..... 273/138.2
6,398,644 B1 6/2002 Perrie et al.
6,419,225 B2 * 7/2002 Sines et al. ..... 273/121 B
6,419,226 B2 * 7/2002 Krise et al. ..... 273/121 A
6,443,837 B1 * 9/2002 Jaffe et al. ..... 463/16
6,565,436 B1 * 5/2003 Baerlocher ..... 463/26
6,572,472 B1 * 6/2003 Glavich ..... 463/16
6,582,307 B2 * 6/2003 Webb ..... 463/22
6,595,854 B2 * 7/2003 Hughs-Baird et al. ..... 463/20
6,619,659 B2 9/2003 Krise et al.
6,638,164 B2 * 10/2003 Randall et al. ..... 463/20
6,645,071 B2 11/2003 Perrie et al.
6,645,073 B2 * 11/2003 Lemay et al. ..... 463/20
6,645,074 B2 * 11/2003 Thomas et al. ..... 463/20
6,648,759 B2 * 11/2003 Vancura ..... 463/20
6,685,563 B1 * 2/2004 Meekins et al. ..... 463/25
6,702,670 B2 * 3/2004 Jasper et al. ..... 463/20
6,705,944 B2 * 3/2004 Luciano ..... 463/20
6,726,563 B1 * 4/2004 Baerlocher et al. ..... 463/25
6,743,094 B2 * 6/2004 Johnson ..... 463/17
6,746,327 B2 * 6/2004 Frohm et al. ..... 463/16
2001/0009316 A1 * 7/2001 Krise et al. ..... 273/108
2001/0009317 A1 * 7/2001 Sines et al. ..... 273/121 B
2002/0180145 A1 * 12/2002 Krise et al. ..... 273/120 A
2002/0180146 A1 * 12/2002 Sines et al. ..... 273/121 B

* cited by examiner 220
30
10
210
230
40B
40A
22
240
24
270
40C
26
20
28

PACHINKO STAND-ALONE AND BONUSING GAME WITH DISPLAYED TARGETS

RELATED APPLICATIONS

This application is a continuation-in-part of U.S. patent application Ser. No. 10/161,568 filed Jun. 3, 2002 which is a continuation of U.S. patent application Ser. No. 09/632,357 filed Aug. 3, 2000, now U.S. Pat. No. 6,398,219 issued Jun. 4, 2002, which is a continuation of U.S. patent application Ser. No. 09/442,831 filed Nov. 17, 1999, now U.S. Pat. No. 6,139,013 issued Oct. 31, 2000, which is a continuation of U.S. patent application Ser. No. 09/098,804 filed Jun. 17, 1998, now U.S. Pat. No. 6,047,963 issued Apr. 11, 2000 which claims priority to U.S. Provisional Patent Application Ser. No. 60/081,724 filed Apr. 14, 1998.

BACKGROUND OF THE INVENTION

1. Field of the Invention

The present invention relates to Pachinko games and, in particular, to a Pachinko stand-alone game and to a Pachinko bonus game for an underlying game such as a slot machine.

2. Statement of the Problem

Slot machine bonusing features have become popular, and examples of their success include WHEEL OF GOLD, WHEEL OF FORTUNE, JEOPARDY!, REEL 'EM IN, PIGGY BANKIN', and many others. What has been heretofore lacking is a bonus game which utilizes the excitement and dynamic qualities of Pachinko. A need exists to provide a form of Pachinko as a bonus game for an underlying game such as a slot machine.

One problem associated with Pachinko games is that wear and tear caused by repeated play causes bias to occur wherein a ball may more frequently pass through certain lanes rather than through other lanes. A need exists to provide random payoffs during the play of Pachinko whether as a bonus game for an underlying game or as a stand-alone game despite bias caused by wear and tear.

A need also exists to provide additional excitement to the conventional play of a game such as video poker, slot machines and the like by providing additional random play in the dispensing of different values when a winning combination on the game is obtained.

SUMMARY OF THE INVENTION

Solution to the Problem

The present invention addresses the aforesaid needs. The Pachinko bonus game of the present invention is placed near an existing slot machine such as on top of, at the rear of, side-by-side with, or located near (such as on a wall). The Pachinko bonus game is started when an initiation condition such as when a symbol or combination of symbols align on the payline of the slot machine. The payoff selection and display on a per game basis is random so that biasing caused by wear and tear is eliminated whether the Pachinko game is played as a bonus game or as a stand-alone game. The Pachinko game can be used to dispense payoffs for conventional winning combinations of the underlying game.

Summary

The present invention pertains to a Pachinko bonus game system for an underlying game machine (such as a slot machine) being played by a player. The underlying game machine has a credit meter. The Pachinko bonus game system provides a playing field wherein the playing field has a plurality of rows of pegs with each row of pegs staggered from each adjacent row. A ball is launched onto the playing field by a launch mechanism. The launching or propelling of the ball onto the playing field occurs when an initiate condition occurs during play of the underlying game. In the case of a slot machine, the initiate condition can be the appearance of a special symbol on the payline. A number of different initiate conditions can be utilized based upon the underlying game. A row of lanes are provided on the playing field. The ball, after traversing among the pegs on the playing field, eventually travels through one of the lanes. At each lane is displayed a bonus payoff value. The lane the ball travels through senses the presence of the ball and the value displayed for that lane is added to the credit meter. The bonus payoff values are displayed at each lane with a flush mounted display so as not to interfere with or impede the travel of the ball through the lane. The bonus payoff values are randomly changed which would eliminate any mechanical bias present in the Pachinko game.

The Pachinko stand-alone game operates independently of an underlying game and is conventionally activated by a player to play the game. However, the playing field, ball, launch mechanism, rows of lanes, and the payoff display are as described above for the Pachinko bonus game with the exception of the credit meters in the Pachinko stand-alone game.

A bonus game for an underlying base casino machine played by a player wherein the bonus game further provides a Pachinko playing field, a ball propelled onto the Pachinko playing field when a bonus condition occurs during play of an underlying casino game. The Pachinko playing field having a row of lanes so that the ball, after traversing the playing field, travels through one of the lanes. A display at said row of lanes on said playing field for displaying at the lanes, targets, digits used to form a decimal number, graphic symbols used to perform a mathematical operation, symbols appearing in the underlying game outcome, so as to provide awards, wild symbols, extended game play, etc. Variations of the bonus game are found in scratch lottery tickets, standalone casino games, and features to gaming machines and systems.

And in yet another embodiment of the present invention, the Pachinko game system operates as a payoff dispenser for a conventional game.

DETAILED DESCRIPTION OF THE INVENTION

Overview

Figure 1:
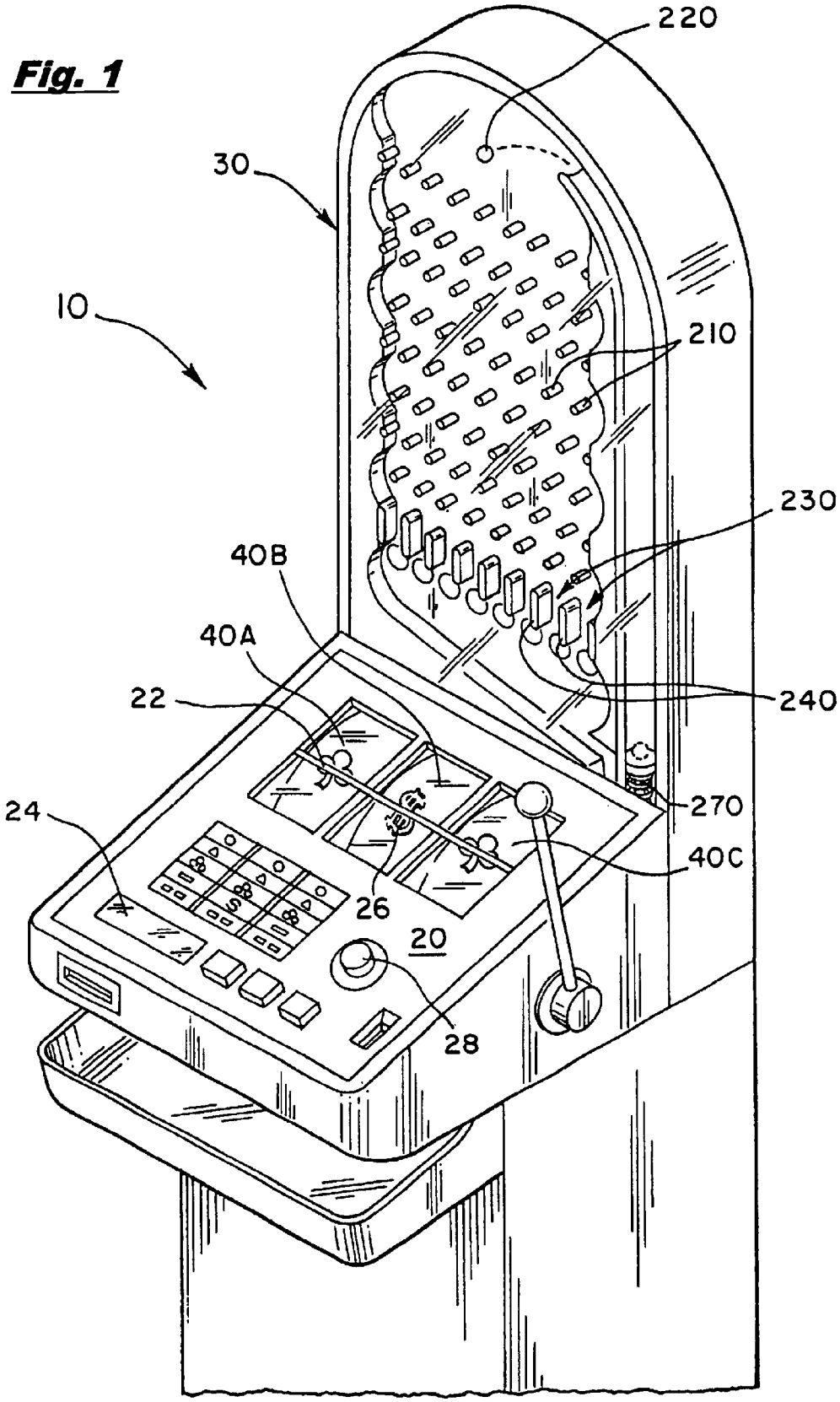
FIG. 1 illustrates the Pachinko bonus game of the present invention associated with a slot machine.

In FIG. 1, the system 10 of the present invention is shown to include an underlying game such as a conventional slot machine 20 modified according to the teachings herein and a Pachinko bonus game 30 also modified according to the teachings herein. In FIG. 1, which represents one embodiment of the present invention, the Pachinko bonus game 30 is vertically mounted at the rear of a slanted slot machine 20. The Pachinko bonus game is located at the slot machine 20. The term "at" includes locating the Pachinko bonus game 30 "at the rear of," "on top of," "side-by-side with" or "near" the underlying game 20. Furthermore, one Pachinko bonus game 30 could be used with a number of underlying games 20 such as twenty slot machines. In which case, the Pachinko bonus game would be mounted at a central location such as on a wall above the slot machines. Furthermore, the underlying game 20 can be any suitable game such as, but not limited to: slot machines, video poker, and other automated gaming machines, live-table games, and other games of chance. In the following the configuration of FIG. 1 is used to illustrate the teachings of the present invention. For example, the Pachinko bonus game could be located near the slot machine 20, such as mounted on a wall and connected thereto by a cable.

The adjacent slot machine 20 functions conventionally when taking wagers, making payments and being played. The slot machine 20 has a conventional credit meter 24 which displays the player's current credits. Slot machines 20 are conventional and are made by a number of different manufacturers. How and in what form (i.e., coin-ins, dollar acceptors, magnetic cards, smart cards, etc.) wagers are placed at the slot machine 20 by a player is immaterial to the teachings of the present invention. What is material is that the credit meter 24 of the slot machine 20 is modified to increase when the player wins at the Pachinko bonus game 30. In addition, should an initiation condition arise during play of the slot machines such as a special symbol 26 (or set of symbols) appearing on the payline 22 of the slot machine 20, it automatically activates the Pachinko bonus game 30 (and deactivates the slot machine 20) so that the player of the slot machine 20 can play the Pachinko bonus game 30. Other means to "initiate" the Pachinko bonus game 30 are possible. The occurrence of a "winning combination" in the underlying game such as "two cherries" in a slot machine, or "twenty-one" in a blackjack game, or "three twos" in joker poker. The occurrence of the player accumulating a predetermined amount of winning such as "seventyseven" dollars (or coins) in the underlying game. The occurrence of a symbol such as a "bonus" symbol appearing anywhere in the window or field of view in a slot machine even if it is not on the payline or receiving a card in a card game having a bonus symbol on it. The occurrence of an event such as a random signal to participate in the bonus game.

When utilized as a bonusing mechanism, the preferred Pachinko bonus game 30 embodiment utilizes one ball 220, which is propelled up onto a playing field 200 comprising alternately spaced rows of pegs 210. After traversing the playing field 200, the ball 220 falls through one of a plurality of chutes or lanes 230 separated by bumpers 240. The player receives an appropriate bonus payoff corresponding to the lane 230 the ball 220 travels through. The bonus payoff is credited to the slot game meter 24. The bonus game 30 ends and play reverts to the slot machine 20. The Pachinko game could also have a separate credit meter which is selectively incremented.

Details of Pachinko Game 30

Figure 2:
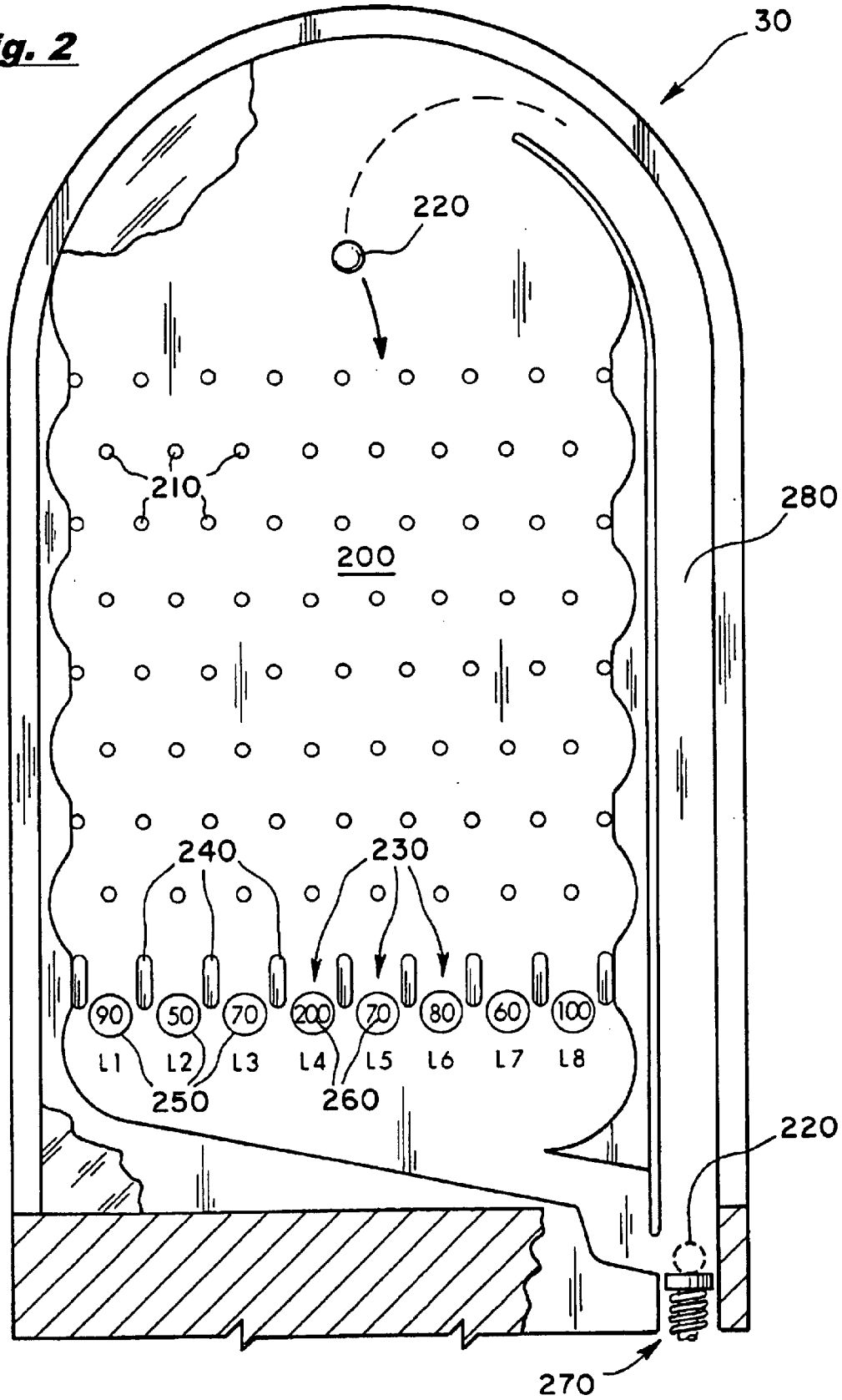
FIG. 2 is a front view of the Pachinko bonus game of the present invention.

In FIG. 2, the Pachinko bonus game 30, in the preferred embodiment, has eight payable lanes 230: L1–L8. Any suitable number of lanes 230 could be used such as but not limited to 6, 10, 13, etc. The displays 250 shows the payoffs in each of the eight lanes to the player. Each payoff display 250 is a digital meter which is flush mounted in the field 200 so as not to interfere with the ball 220. The displays 250, in some embodiments, may be located in a separate viewing area on the Pachinko bonus game 30 although it is preferred to have the displays 250 located at (i.e., in, above, or near) the lanes 230 so that a player may easily view the bonus payoff for that lane. The display 250 is a conventional digital display such as an LED and it may be circular, square, or any suitable shape or design. It is to be expressly understood that in certain embodiments of the present invention, the display 250 can be simply printed with fixed bonus payout values. As will be explained in the following, in the preferred embodiment the displays 250 are utilized to display individual payout values 260 for each lane 230. Furthermore, the actual design of the field 200 for the Pachinko bonus game 30, as is conventionally done, varies considerably from manufacturer to manufacturer. Hence, the present invention is not meant to be limited by the design characteristics of the Pachinko game 30.

In the preferred embodiment, the Pachinko game 30 of FIG. 2 becomes activated when an initiation condition occurs in the underlying game 20. For example, in FIG. 1, the appearance of a dollar sign 26 anywhere on the payline 22 allows the player to play the Pachinko bonus game 30. Any symbol or combination of symbols may be used to activate the Pachinko bonus game 30 such as, but not limited to, a graphic Pachinko symbol, a four-leaf clover, or the word "bonus." When the Pachinko game is activated, a light and sound campaign can be used to signal to people in the vicinity of the player's opportunity to play the Pachinko bonus game 30. The player pushes button 28 to activate the firing mechanism 270 which launches the ball 220 upwardly in area 280 and onto the playing field 200. In another design, the ball launch is automatic and occurs automatically after the initiation condition occurs. Assume in FIG. 2, that the ball 220 is directed through lane L6 in which case the player receives the payoff 260 displayed in display 250 of $80 (or 80 coins). The credit meter 24 of the slot machine 20 is then incremented by the value of the payoff. The payoff could also be made in coupons, tickets, free plays, etc. In which case, the credit meter 24 would not be incremented. It is to be understood that a separate credit meter, not shown in FIG. 4, but shown in FIG. 6, could be utilized to keep track of the bonus payoffs.

The ball 220 is preferably three-quarters of an inch to one and one-half inch in diameter (i.e. about one inch). For example, in games 30 mounted on a wall, the ball 220 and pegs 210 would be scaled up such as having wider lanes. The pegs 210 are preferably on one and one-half to two-inch centers and each peg is preferably three-sixteenths an inch in diameter. Each row of pegs 210 is preferably staggered from the adjacent row above and below by one-half the center-to-center distance between pegs 210. These dimensions illustrate the present invention and are not meant to limit the teachings thereof. While the present invention uses one ball 220 per bonus, it is to be understood that more than one ball 220 could be used and that more than one ball 220 could be simultaneously or successively launched.

It is important to prevent outside influences from affecting the operation of the Pachinko bonus game 30 such as 1) possible tilting of the Pachinko game 30 to coax the ball 220 into desirable lanes 230 and 2) possible use of magnets to coax a steel or magnetic ball. Both of these concerns are eliminated in the present invention by using leveling sensors and a non-magnetic ball 220. While the use of plastic is preferred, the teachings of the present invention are not limited to plastic and other non-magnetic materials may be used. Furthermore, the algorithms and methods contained herein would also apply to conventional steel balls. Hence, the teachings of the present invention are not to be limited to use of either plastic balls or leveling sensors.

Algorithms

Algorithms for assigning the bonus game 30 values 260 to the lanes L1–L8 include, but are not limited to, the following three algorithms:

Algorithm No. 1

The slot machine 20 assigns a random payoff value 260 to the bonus game 30, either before or during play, that is independent of the outcome of the Pachinko action. After the ball 220 travels through a lane 230, the predetermined random payoff value 260 is displayed in display 250. Under this algorithm, the value of bonus payoffs is not determined by the ball 220 play in the Pachinko game.

Algorithm No. 2

Bonus payoff values 260 are randomly assigned to each lane 230 as a function of time and based upon game play. The value 260 for the bonus game 30 is determined by the displayed lane value at the time the ball 220 passes through a lane 230. This algorithm can either be free running (i.e., continuously) or start when the Pachinko bonus game 30 is activated. If free running, the cycle time for displaying a set of bonus payoffs 260 in displays 250 is preferably less than the typical Pachinko bonus game cycle time. For example, if it takes an average five seconds to play the Pachinko bonus game 30, then the payoff cycle time could be two seconds. In this example, every two seconds new payoffs 260 would be randomly displayed in displays 250. The display cycle time cannot be too fast since it must be viewed by a player, nor can it be too slow, if free running, since a player could take advantage of high payout values. Under the teachings of the present invention, the display cycle time, $T_D$, is preferably less than the game cycle time, $T_G$, or $T_D \leqq T_G$.

It is to be understood that the display in each lane could change at the same time; or the display in each lane could change at staggered times. For example, the first lane at time $T_0$, the second lane at time $T_0+T_S$, the third lane at time $T_0+2T_S$, etc.; where $T_S$ is a predetermined stagger time period. This creates a flickering effect which is aesthetically pleasing.

In yet another embodiment, the time a value is displayed in a lane is constant (equal), but the frequency of selection is based upon the weight of the value. For example, if the values are ten dollars and one hundred dollars and the respective weights are 50% and 5%, then each value is displayed for the same amount of time (e.g., two seconds), but the ten-dollar value is displayed 50% of the overall time and the one hundred dollar value is displayed 5% of the overall time.

In yet another embodiment, the weight for each lane is constant (equal), but the frequency of selection is based upon time. For example, if the values are ten and one hundred dollars and the respective weights are each 50%, then each value has the same probability of being displayed, but the time of displaying the ten-dollar value is much longer than the time for displaying the one hundred dollar value.

Algorithm No. 3

Bonus payoff values 260 are assigned and displayed in displays 250 to each lane 230 randomly, via a weighted probability pay table, at any time after the bonus game 30 is activated and before the ball 220 travels through a lane 230. These bonus payoff values 260 remain fixed and the lane 230 selected by the ball 220 determines the ultimate payoff amount for the bonus game.

Algorithm No. 3 is the preferred embodiment for determining bonus payoff values 260 in that it allows players to see what bonus payoffs are possible, and to root for the ball 220 to settle into lanes 230 with high potential payoffs. It also gives players reassurance in knowing that no "funny business" is taking place (i.e., after launch the values 260 are fixed and known to the player, and subsequently the ball 220—and the ball 220 alone—determines the bonus payoff 260 the player will receive).

Bonus Payoff Values 260 Details Based on Algorithm No. 3

The above three algorithms are preferred embodiments. Other algorithms could be equivalently used under the teachings of the present invention.

Assume the desired average bonus payoff value for the Pachinko bonus game 30 is D units. The term "units" is used to refer to any suitable bonus payoff form such as monetary value (dollars), numbers of coins (number of quarters), tickets, etc. The teachings of the present invention are not limited to the form of the bonus payoff. Two preferred methods are used to determine the payoff.

Method 1: This method assigns bonus payoff values 260 to each lane 230 such that the expected value per lane 230 remains at D units, while particular bonus payoff values fluctuate above and below D units. In this fashion, the average value per game still remains at D units, but players experience variety in game play.

In Method 1, the average value per game remains equal to D units regardless of any bias which may exist or which may develop in the Pachinko bonus game 30 toward the lanes 230 and is accomplished in the following manner.

Let the number of lanes be $N_L$ and the number of payoffs for lane l be $R_l$. The set of payoffs and their associated weights (i.e., probabilities) for lane l is $P_{l,k}$ and $w_{l,k}$, where k is an index assuming values from 1 to $R_l$. Let the desired average value for the game be D. Then for each lane l the expected value becomes:

$$EV_l=\Sigma_k(w_{l,k}\times P_{l,k})=\text{a constant} \qquad \text{FORMULA 1}$$

where $EV_l$=Expected Value for lane l $P_{l,k}$=Set of rewards for lane l $w_{l,k}$=Weights per lane l Summing over the game lanes, with unknown probabilities of occurrence $W_l$, yields the expected value per game:

$$EV=\Sigma_l(w_l\times EV_l)=EV_l\times\Sigma w_l=EV_l \qquad \text{FORMULA 2}$$

Thus EV for the game is simply that of each lane, provided this is constant (i.e., equal for each lane). Furthermore, EV is independent of the weights $w_l$ of occurrence for each lane. Thus any bias developing through wear and tear which affects the $w_l$ has no bearing on EV. With no multiplier (M=1), the solution is EV=D. This is an important advantage of the present invention that the bonus payoff values 260 of the game are unaffected by physical wear and tear of the associated hardware. That is, even if the Pachinko bonus game 30 becomes biased toward one or more lanes 230, the bonus payoff value 260 of the game is unchanged. Randomness and fairness to the house and to the player is maintained. In the worst case of bias, the ball would fall through the same lane, game after game, yet the value, D, for the game is recovered.

Assume the Pachinko bonus game 30 has a value, per play, of EV=D=50 units, then the following is an example of random assignments for each lane L1–L8 of FIGS. 1 and 2:

TABLE I

| | Weights/Lane | | | | | | | | |
|---|---|---|---|---|---|---|---|---|---|
| Payoff | L1 | L2 | L3 | L4 | L5 | L6 | L7 | L8 | |
| 10 | 0.15 | 0 | 0 | 0.7 | 0 | 0 | 0 | 0 | |
| 20 | 0.1 | 0 | 0 | 0 | 0 | 0 | 0 | 0.1 | |
| 30 | 0.1 | 0 | 0.25 | 0.1 | 0.2 | 0.4 | 0 | 0.6 | |
| 40 | 0.1 | 0 | 0 | 0 | 0.2 | 0.2 | 0.5 | 0 | |
| 50 | 0.1 | 1 | 0.5 | 0 | 0.2 | 0 | 0 | 0 | |
| 60 | 0.1 | 0 | 0 | 0 | 0.2 | 0 | 0.5 | 0 | |
| 70 | 0.1 | 0 | 0.25 | 0 | 0.2 | 0.2 | 0 | 0 | |
| 80 | 0.1 | 0 | 0 | 0 | 0 | 0.2 | 0 | 0 | |
| 90 | 0.15 | 0 | 0 | 0 | 0 | 0 | 0 | 0 | |
| 100 | 0 | 0 | 0 | 0 | 0 | 0 | 0 | 0.3 | |
| 200 | 0 | 0 | 0 | 0.2 | 0 | 0 | 0 | 0 | |
| | 50 | 50 | 50 | 50 | 50 | 50 | 50 | 50 | EV |

For example, for lane L4, there is a 70% chance the payoff chosen is 10 units, a 10% chance it is 30 units, and a 20% chance it is 200 units. The expected value for lane 4 is therefore 0.7×10+0.1×30+0.2×200=50 units, as required.

It should be apparent that the average bonus payoff value for each lane 230 is 50 units. However, the weights and associated possible bonus payoffs for each lane can be very different from each other. Furthermore, not all payoffs need to be possible for each lane, and vice-versa.

Several examples will illustrate the operation of Table I. In the first example, assume that the controller (as will be discussed subsequently) selects the following payoff values for L1–L8 of FIG. 2: {90, 50, 70, 200, 70, 80, 60, 100} which is shown in FIG. 2. In this first example, the controller has selected the highest bonus payoff combination for each lane which is possible under this method. It is also possible, under this method and as a second example, that the lowest combination of values could be selected and displayed in L1–L8: {10, 50, 30, 10, 30, 30, 40, 20}. The second example represents the lowest payoffs that can be selected for each lane. Of course, any random combination of payoffs 260 based upon the percentage weights per lane could be selected by the controller from the payoff values in Table I. It is noted that for lane L2 in Table I, the payoff value of 50 is always selected. Under the teachings of the present invention any set of payoffs are possible such that Formula I is satisfied.

Further, to add even more randomness, the lanes L1–L8 can be rotated from game to game (i.e., the weights for lane 1 may be applied to lane 2 in the next game, and so forth). The fixed value of 50 for lane L3 in Table I would be the value for lane L4 for the next game, for lane L5 etc. Or, the mapping from Table I for each successive game to actual lanes 230 may be done in a random fashion. The fixed value of 50 for lane L3 in Table I would be the value for a randomly selected lane such as lane L7 for the next game.

Note, too, that this algorithm does not require that each expected payoff, on a per-game basis, is always exactly D units. This volatility is a further advantage of this approach. For a third example, the lane payoff values are randomly chosen to be: {80, 50, 50, 200, 30, 40, 60, 30} for lanes L1 through L8, respectively. The probability of this occurring is 0.00012, and the expected value for the bonus game 30 is greater than 50 units. However, in the long run, the payoff will average D units.

Table I represents an illustration showing how bonus payoff values 260 are randomly selected from bonus game to bonus game. Many other values of combinations are possible which fall within the teachings of the present invention. D may be any suitable value, the number of lanes L are a design choice, and the actual payoff values can be tailored to the casino's requirements. A low value of D, such as D≦5, would generate little excitement in playing the Pachinko bonus game 30, while a high value of D, such as D≧100, would generate higher excitement. Also of consideration is how frequently the bonus symbol(s) 26 stop at the payline 22. The more frequent, then a lower D may be desirable. The lower the frequency, then a higher D may be desirable.

Method 2: An alternate approach which yields the same expected value EV each game is to randomly select a set of bonus payoff values 260 whose average value is D, and then assign each element of this set randomly to a lane 230.

For example, consider the set of lane payoffs L1–L8: {20, 20, 30, 40, 40, 50, 100, 100} with an average value D=50. Each of these payoff values 260 are randomly mapped to a lane in a one-to-one fashion, thus ensuring a game of value D. No equipment bias affects the expected value of the game, through the random assignment of values to lanes. In choosing different sets of lane payoffs, the volatility of playing the bonus game 30 may be increased or decreased.

A modified form of Methods 1 and 2 is to tie into the temporal approach of Algorithm 2 by randomly varying the lane value 260 as a function of time, with frequency governed such that the time-averaged value is D (e.g., by Table 1 above). This can be done by, e.g., fixing the time of a reward at $T_D$ and selecting based on weight w, or fixing the selection as the same for all and selecting the period proportionate to weight. Other manifestations are possible. Provided that the period (time between changing values) is shorter than the typical cycle time for a ball to drop through a lane, but long enough for a player to recognize the present lane value, the game should provide considerable excitement.

Under the teachings of the present invention, instead of credits, prizes or other types of awards may be provided.

Lane Multiplier(s) Algorithm

In addition to the algorithms described above, additional lanes are provided elsewhere on the playing field 200 in an alternate embodiment. Such rows could be added above or below lanes L1–L8.

Figure 3:
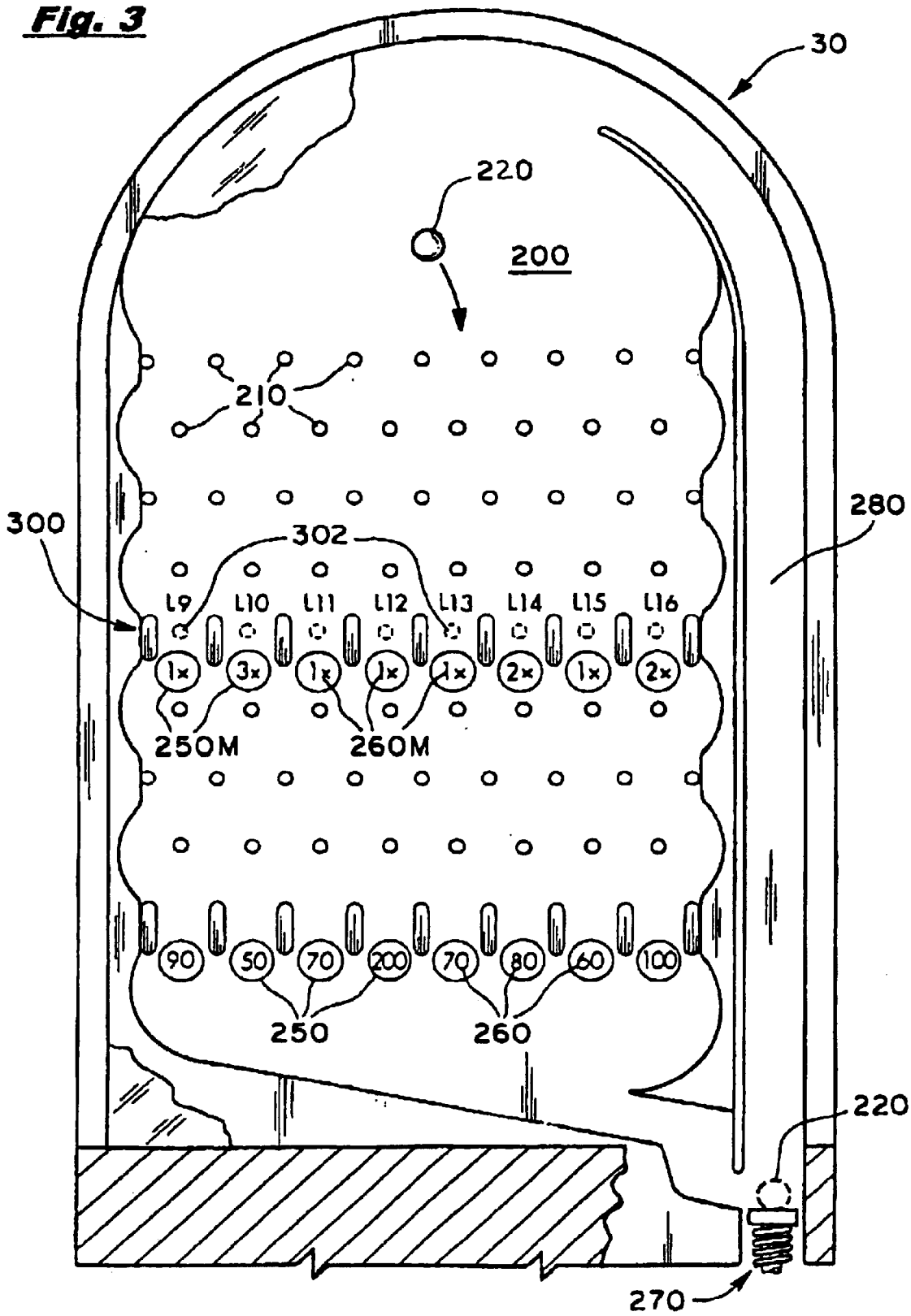
FIG. 3 is a front view of a second embodiment of the Pachinko bonus game of the present invention.

Consider the embodiment shown in FIG. 3 in which an additional row 300 of lanes L9–L16, positioned midway through the playing field 200, is utilized as a multiplier (i.e., M=1×, 2×, 3×, . . . ). The "X" symbol is used in the following as a "multiply sign." This row contains eight lanes also, each mapped in a random fashion to the set {1×, 1×, 1×, 1×, 1×, 2×, 2×, 3×} for lanes L9–L16. The multiplier value 260M is displayed in flush mounted displays 250M so that a player may easily view the multipliers assigned to that lane. Each new game results in randomly selected values for M for each lane. Then the average value of the multiplier M is 1.5×. This can be multiplied by the value of D for the lower lanes L1–L8 to determine the EV for the game as a whole. To whit, $$EV=M\times D \qquad \text{FORMULA 3}$$

Alternately, the values for the multipliers may be chosen in a fashion similar to that described in Method 1 above.

It is to be expressly understood in this embodiment, that any number of lanes in row 300 could be utilized to provide the multiplication. Furthermore, one or more of the lanes L9–L16 could be a "lose" lane (i.e., O×) so that when the ball 220 falls through that lane, the player loses; in which case when the ball 220 continues to fall and travel through on lanes L1–L8, the payoff value is not recorded. Indeed, passing through a lose lane, in one embodiment, would instantly cause the displays 250 to display "zero" and there could be a multimedia display informing the player and others of the lose. The location and number of the additional lanes L9–L16 is a design choice and they vary in number and can be placed anywhere in the playing field 200 above or below the pay lanes L1–L8. They do not have to be aligned in a row and can be dispersed on the field 200. Indeed, in some designs the ball 220 may enter a first multiplier lane (e.g., 2×) and then a second multiplier lane (e.g., 3×) before entering a payoff lane (e.g., $10—in which case the player receives 2×3×$10=$60). The number of lanes, the position of the lanes, and the number of rows are simply a design choice and do not depart from the teachings of the present invention.

Lane Addition Algorithm

The row 300 in another embodiment could be additive, subtractive, or both. For example, lanes L9–L16 could be {1+, 1+, 1+, 1+, 1+, 2+, 2+, 3+} mapped in a random fashion where the average addition is A=1.5+. In another example, lanes L9–L16 could be {1+, 1+, 1−, 1−, 2+, 2−, 3+, 3−} mapped in a random fashion where the average addition is A=0.

Double-or-Nothing Algorithm

In another embodiment, the player may replay the Pachinko bonus game as follows.

The player is given the option to double-or-nothing the bonus payoff just received such as by re-pushing a button 28 in FIG. 1. Should the player decide to risk the winnings from the prior Pachinko bonus game, the Pachinko lanes L1–L8 would then be displayed in meters 24 with either a "Double" or "Nothing" symbol. By randomly assigning four "Double" symbols and four "Nothing" symbols to the bottom eight lanes L1–L8 prior to re-propelling of the ball 220, the chances are 50/50 for success/failure each game. As before, this will be true despite any lane bias that may be present in the equipment.

Other variations in this embodiment include triple, quadruple, etc., or nothing. For example, lanes L1–L8 could have the set {0×, 0×, 0×, 0×, 0×, 2×, 2×, 4×} randomly mapped to it resulting in an average multiplier of M=1.

Payoff Display Sequence

The displays 250 operate in several different sequences under the teachings of the present invention. In a first display sequence, the displays 250 for all lanes simultaneously display the payoff values 260. In a second display sequence, the displays 250 operate to randomly flicker payoff values 260 at different staggered times so that while a display in one lane is present, a display in another lane is just being displayed, etc. In a third display sequence, the time that a particular payoff value 260 is displayed in a lane 230 is proportional to the payoff weight so that a two hundred dollar payoff would have a shorter display time and a ten dollar payoff would have a faster display time.

Stand-Alone Pachinko Game

The algorithms of the present invention can also be employed if the Pachinko game is a stand-alone machine. In this case, however, some of the payoff values are net losers based on coin-in. To encourage variety in the lane payoff values, and to allow for a variety of house advantages, Method 1 coupled with either Algorithm No. 2 or Algorithm No. 3 is preferred in this case.

Consider a stand-alone five-coin Pachinko game with a desired 10% house advantage. Assume the multiplier value is fixed at M=1×. To obtain a payoff value of D=4.5, the following is an example:

TABLE II

| | Weights | | | | | | | | |
|---|---|---|---|---|---|---|---|---|---|
| Payoff | L1 | L2 | L3 | L4 | L5 | L6 | L7 | L8 | |
| 0 | 0.2 | 0.2 | 0 | 0.855 | 0.955 | 0.55 | 0 | 0.5 | |
| 1 | 0.2 | 0 | 0 | 0 | 0 | 0 | 0 | 0 | |
| 2 | 0.1 | 0 | 0 | 0 | 0 | 0 | 0 | 0 | |
| 3 | 0.1 | 0 | 0 | 0 | 0 | 0 | 0.1 | 0 | |
| 4 | 0.2 | 0.5 | 0.5 | 0 | 0 | 0 | 0.3 | 0 | |
| 5 | 0.1 | 0.1 | 0.5 | 0 | 0 | 0 | 0.6 | 0.1 | |
| 10 | 0 | 0.2 | 0 | 0.1 | 0 | 0.45 | 0 | 0.4 | |
| 25 | 0.1 | 0 | 0 | 0.04 | 0 | 0 | 0 | 0 | |
| 100 | 0 | 0 | 0 | 0 | 0.045 | 0 | 0 | 0 | |
| 500 | 0 | 0 | 0 | 0.005 | 0 | 0 | 0 | 0 | |
| | 4.5 | 4.5 | 4.5 | 4.5 | 4.5 | 4.5 | 4.5 | 4.5 | EV |

As before, the value for each lane 230 is chosen randomly by a controller and displayed in displays 250, with weights according to Table II above. In so doing, any equipment bias in the stand-alone Pachinko game is nullified with respect to house advantage. In the example above, lane 5 will have a value of 100 coins 4.5% of the time. A 500-coin payoff in lane 4 will appear once every 200 games.

These payoffs are merely exemplary and can, of course, be modified to the particular design. Table II does demonstrate, however, the mechanism whereby large "jackpot" values will periodically appear as possible payoffs and wherein the payoff values 260 in displays 250 are randomly changed from game to game.

These large jackpots can also arise from the use of multiple rows of lanes possibly including multipliers, additions, etc.

Bonus Game Hardware Configuration

Figure 4:
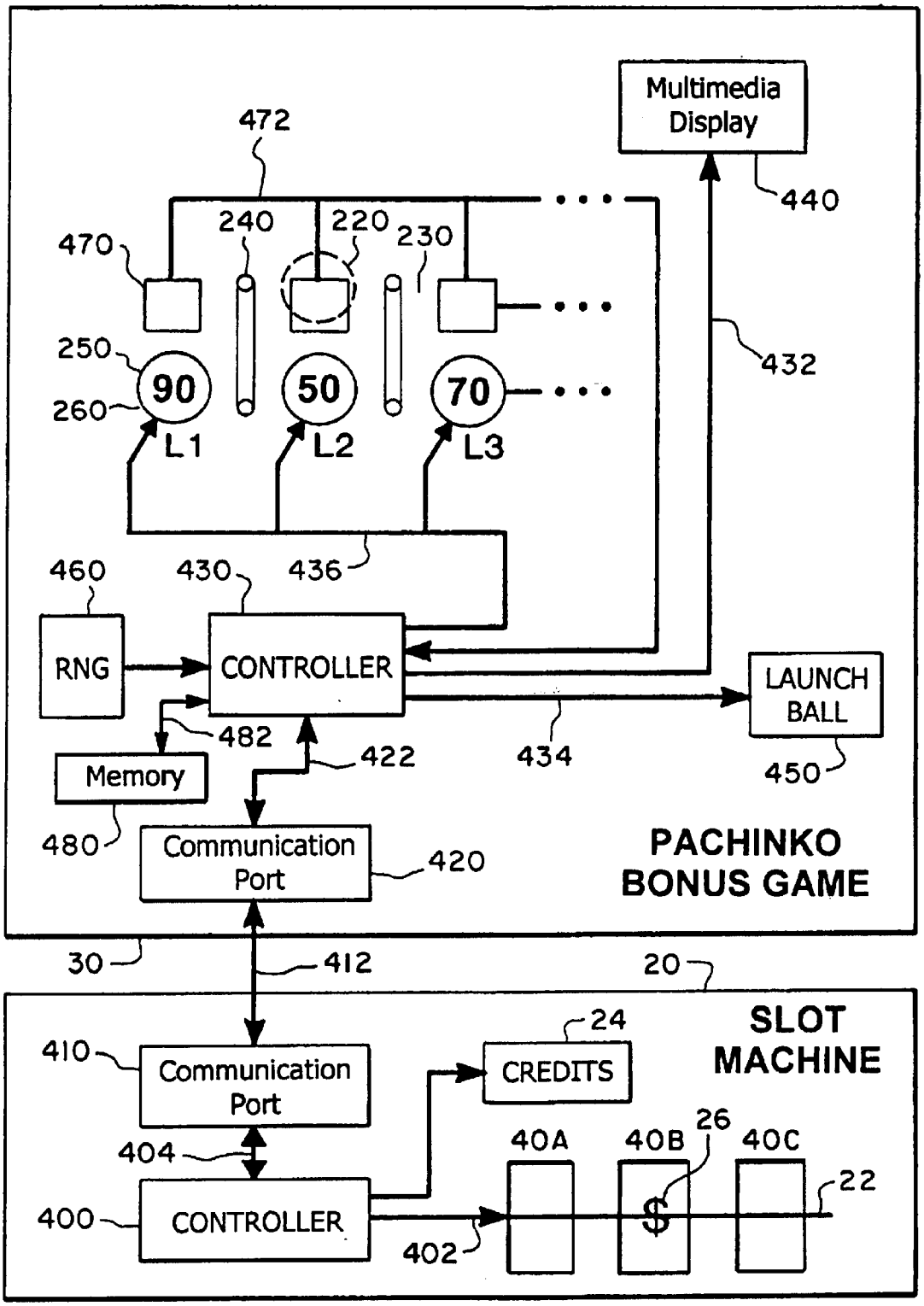
FIG. 4 is a block diagram of the interconnection showing the components of the Pachinko bonus game connected to the slot machine.

FIG. 4 sets forth the details of the interconnection between the slot machine 20 and the Pachinko bonus game 30 of the present invention. The slot machine 20, as mentioned, may be any one of a large number of different slot machines from a wide variety of manufacturers. Modern slot machines 20 typically have reels 40A, 40B, and 40C which may be mechanical or electronic. However, any number of reels could be used. For example, the slot machine 20 may be played on a CRT screen. The design and operation of a slot machine 20 are well known. Under the teachings of the present invention, as shown in FIG. 1, a special symbol or symbols 26 is added to the control software for the slot machine controller 400 and to the reels 40A, 40B, and 40C. As discussed, the present invention is not limited to this one approach to "initiation" of the bonus game 30. The controller 400 is conventionally a microprocessor-based computer. When the special symbol or symbols 26 appears on the payline 22 of reels 40A, 40B, and 40C, as functionally represented by line 402, the controller 400 pauses or deactivates the slot machine game and delivers a communication over line 404 to a communication port 410 for delivery over lines 412 to a communication port 420 in Pachinko bonus game 30. This communication over lines 412 is an activation signal to activate the Pachinko bonus game 30. The Pachinko game controller 430 upon receipt of the activation signal initiates over lines 432 a multimedia display 440 on or near the Pachinko bonus game 30 which may be comprised of sounds (such as words and/or music), signage (such as a digital display announcing a bonus game), or graphics (such as a moving ball). The use of a multimedia display 440 is optional under the teachings of the present invention but is preferred and may encompass any of a wide variety of multimedia presentations.

The Pachinko game controller 430, in response to the activation signal received on lines 422 and the activation of button 28 by the player enables the launch ball mechanism 450 over line 434 to launch the ball 220 onto the field 200. Under alternate embodiments, the launch ball mechanism may be mechanically activated by a player such as by conventionally pulling back on a pull rod which is then released to propel the ball up chute 280 and into the playing field 200. Or, in other embodiments, a mechanical ball launcher 450 is used and if the player does not launch the ball within a predetermined time period, such as five seconds, the Pachinko game controller 430 automatically launches the ball. The Pachinko game controller 430, in response to the activation signal over lines 422, selects a set of payoff values 260 for delivery over lines 436 into the displays 250. Several approaches for determining what payoff values 260 are to be displayed have been discussed above. The Pachinko game controller 430 is suitably programmed and works with a random number generator 460 which may be a separate chip or software embedded in the Pachinko game controller 430 to randomly select payoff values from a table in memory 480 over lines 482 such as set forth in Table I.

After the ball 220 is propelled by the launch ball mechanism 450, the ball, after a period of time, travels through one lane 230. In FIG. 4, the ball 220 is shown passing through lane L2. Each lane 230 has a sensor 470 which senses the presence of the ball 220. For example, for a nylon ball 220, a suitable sensor is an infrared sensor or a diode switch flush mounted to field 200. The sensor 470 issues a signal on lines 472 back to the Pachinko game controller 430. In the preferred embodiment, each sensor 470 has an individual line 472 to the Pachinko game controller 430. Hence, the Pachinko game controller 430 knows which lane the ball 220 has fallen through and, therefore, the Pachinko game controller 430 knows which payoff value (in the example of FIG. 4, $50 or fifty coins) is to be awarded the player. The same type of hardware could be used to sense the presence of the ball 220 in a special change value area (such as area 300) with sensors 302 also connected to controller 430. The Pachinko game controller 430 then communicates with slot machine controller 400 through the communication ports 410 and 420 with the payout value 260 information so that the slot machine controller 400 can increment the credit meter 24 in the slot machine 20 with the payoff value 260 (for example $50).

It is to be expressly understood that a number of different designs could be implemented under the teachings of the present invention. For example, one skilled in the art could remove the random number generator 460 and the Pachinko game controller 430 as well as the communication ports 410 and 420, and have the connections 436, 472, 432, and 434 delivered directly into and under control of the slot machine controller 400.

The field 200 may have any number of recessed lights, lighted designs, and/or sound effects commonly found in Pachinko and pinball games which are not shown and which are controlled by Pachinko game controller 430.

Operation

Figure 5:
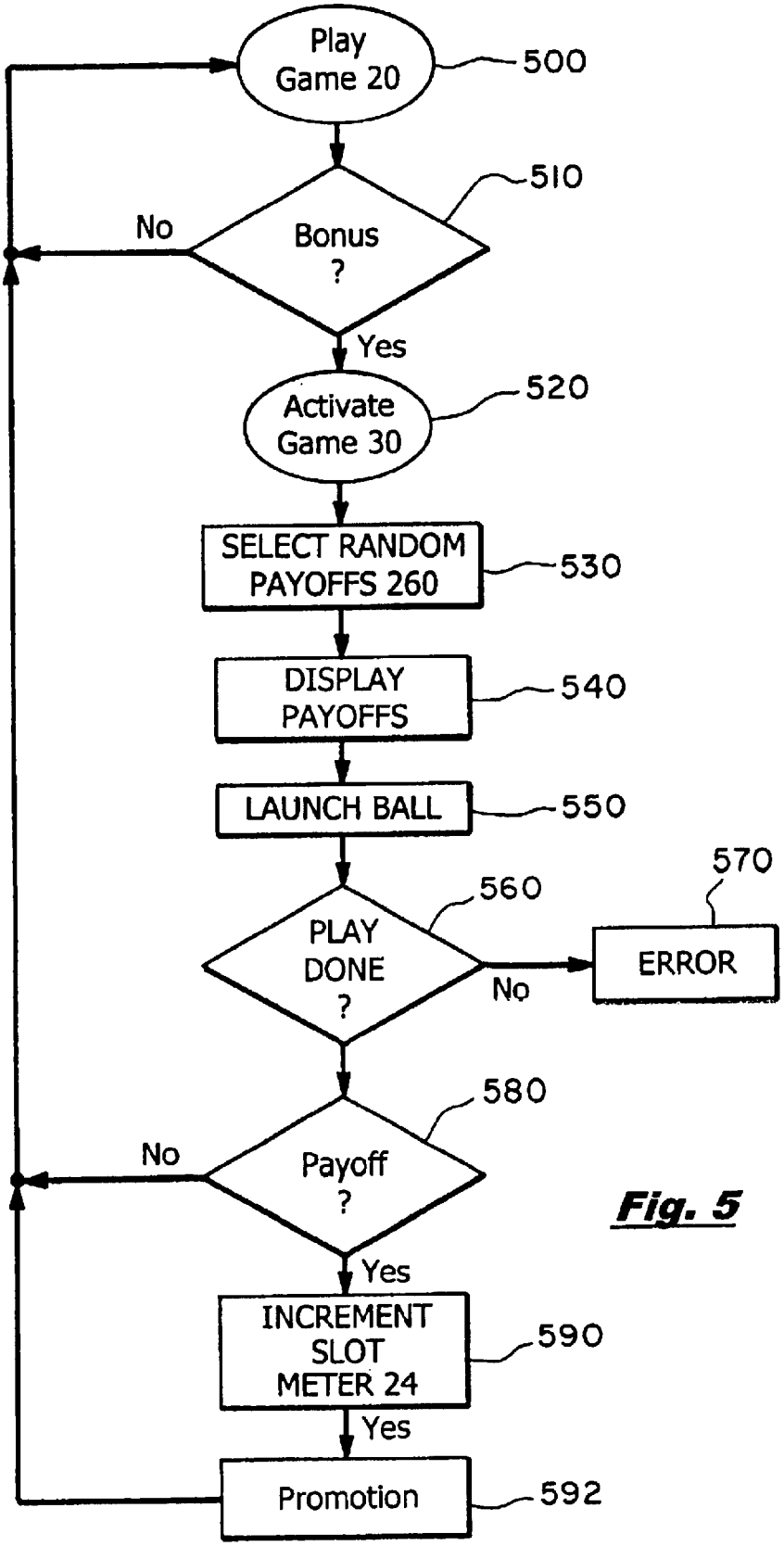
FIG. 5 is an operational flow chart for the Pachinko bonus game of the present invention.

In FIG. 5, operation of the present invention is set forth. In reference to FIG. 4, the slot machine 20 is conventionally played in stage 500. When a bonus symbol 26 appears on payline 22 in stage 510 (or other "initiation"), the controller 400 sends an activation signal to Pachinko game controller 430. Stage 520 is then entered. The Pachinko game controller 430, as discussed, selects random payoffs 260 in stage 530 based upon the random number generator 460 and the payoff table stored in memory 480 and in stage 540 displays them in displays 250. In stage 550, the bonus game is activated with the Pachinko game controller 430 activating launch ball mechanism 450.

It is to be expressly understood that the order of stages 530, 540, and 550 can vary based upon method and the algorithm being used as discussed above as well as other design considerations. For example, if Algorithm No. 2 is used for a simultaneous display, and is based upon a two-second repetitive cycle, then every two seconds stage 530 selects new random payoffs for simultaneous display in stage 540. This continuously occurs until the bonus game play is over with. In the preferred embodiment of Algorithm No. 3, Method 1, the Pachinko game controller 430, at any time after being activated in stage 520 and before play is done in stage 560, can select a random payoff value for display. However, in the preferred operation of Algorithm No. 3, Method 1, sometime after activation in stage 520, the random values 260 are selected in stage 530 for display in stage 540. The launch ball mechanism 450 is then activated in stage 550 and play is done when the ball 220, as shown in FIG. 4, is sensed by one of the sensors 470. If too much time elapses, and the ball 220 is not sensed after launch, an error stage 570 may be entered. When the ball 220 is sensed in a lane 230 in stage 560, then in stage 580, the Pachinko game controller 430 determines the value of the payoff assigned for the lane, delivers that information to controller 400 which then increments the credit meter 24 in stage 590. In stage 592, the Pachinko game controller 430 may cause a multimedia display 440 to occur based upon the win received by the player. After which, play is resumed at the slot machine 20 in stage 500 and the process repeats.

Stand-Alone Pachinko Game

Figure 6:
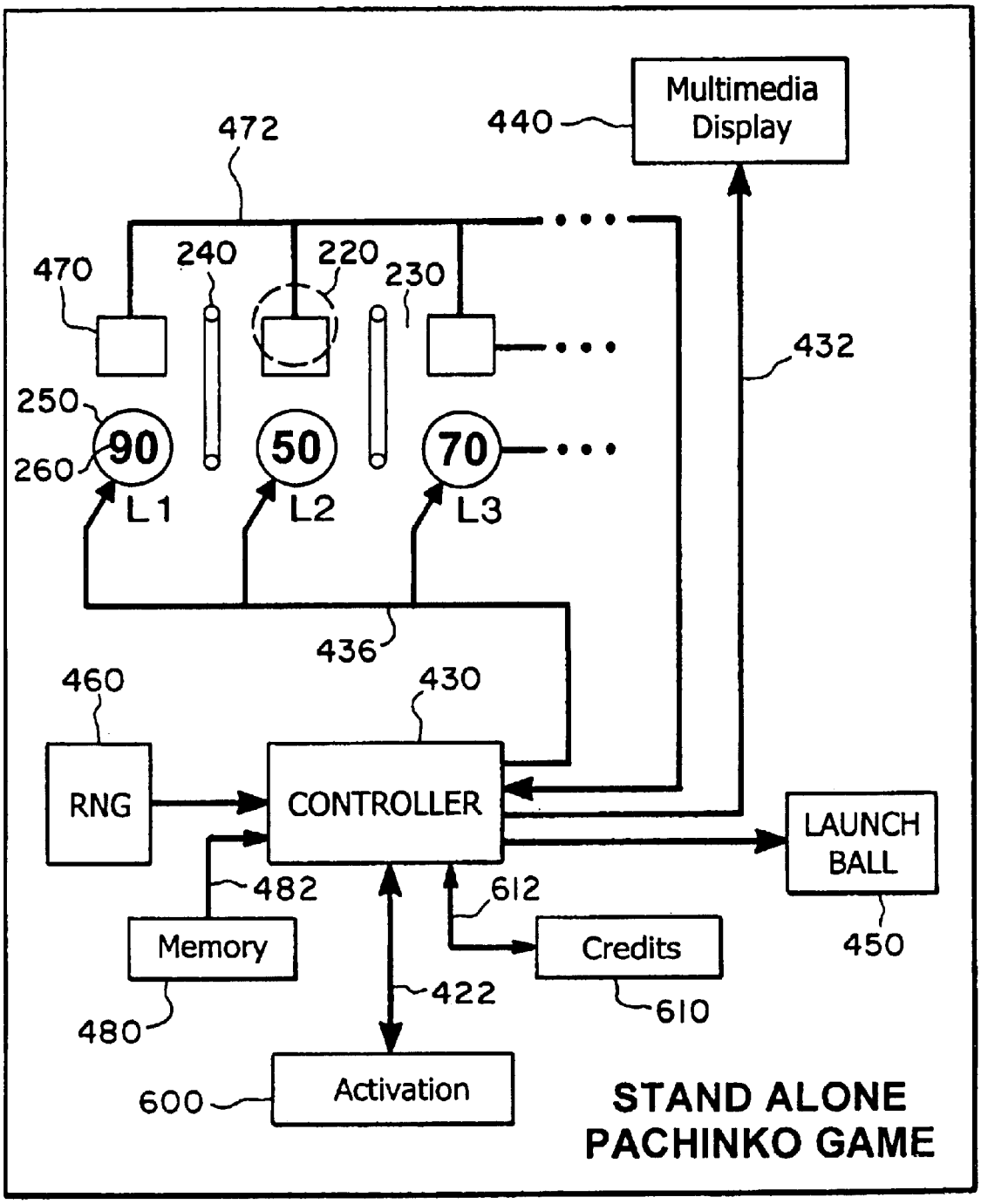
FIG. 6 is a block diagram of the stand-alone Pachinko game of the present invention.
Figure 7:
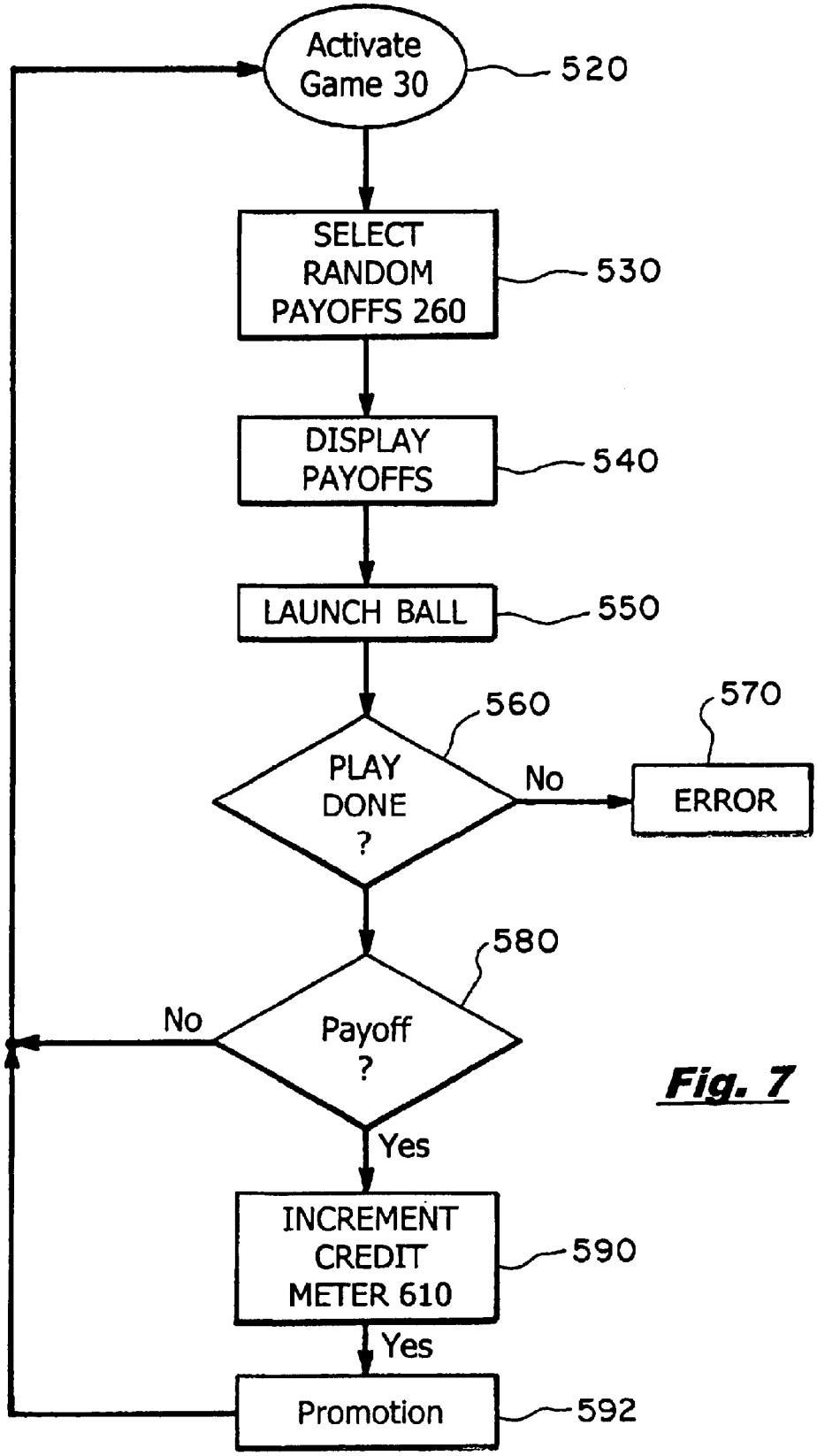
FIG. 7 is an operational flow chart for the stand-alone Pachinko game of the present invention.

In FIGS. 6 and 7, the details of the stand-alone Pachinko game 30 is shown. Where possible, like numbers are utilized which refer to earlier discussed structure and functions.

In FIG. 6, the hardware configuration for the stand-alone Pachinko game 30 is shown. This corresponds to the hardware configuration for the Pachinko bonus game shown in FIG. 6. However, an activation circuit 600 is shown which activates the controller 430 in the manner discussed above. In all other aspects, the hardware configuration for the stand-alone Pachinko game 30 of FIG. 6 corresponds to the discussion of FIG. 4 for the Pachinko bonus game. However, the activation circuit 600 constitutes any suitable activation conventionally used for a casino game such as receiving monetary value in the form of a wager (bill acceptor, coin in, etc.) and an activation signal from the player such as a start button, pulling of a handle, touching of an icon on a screen, etc. In addition, a credit meter 610 is provided in the stand-alone Pachinko game as shown by display 610 which directly communicates with the controller 430 over lines 612. In the event the player wins, the credits 610 are appropriately incremented. In the case a player loses, the credits 610 are appropriately decremented.

Likewise, in FIG. 7, the functional flow chart of the stand-alone Pachinko game 30 is set forth. This corresponds substantially to FIG. 5. Here when the payoff occurs in stage 580, the credit meter 610 of FIG. 6 is appropriately incremented or decremented.

Payoff Dispensing Mechanism

In yet another alternate approach to the teachings of the present invention, Pachinko game 30 of the present invention can utilize as a payoff dispensing mechanism. Formula 1 sets forth an overall payoff value of D as the expected value, EV.

It is well known in conventional game play for an underlying casino machine 20, that payoffs are commonly given. These payoffs are typically shown as printed charts actually on the machine. For example, in the case of the slot machine 20 and three double bars, the payoff printed on the chart may be twenty dollars. A player receiving a winning combination for the underlying casino gaming machine 20 is assured of receiving the printed payoff value. Under the teachings of the present invention, whenever a winning combination is obtained by a player at the underlying gaming machine 20, the Pachinko game 30 automatically is activated to allow the player the opportunity to receive more or less than the printed payoff value. In other words, the Pachinko bonus game of the present invention acts as a payoff-dispensing machine. From the casino operator's point of view, under Formula 1, the casino still pays the printed payout values. However, from the viewpoint of the player, a significant and additional level of excitement and further game play is present in watching the Pachinko game operate to dispense payoff which may be more or less than the stated printed payoffs. In some embodiments of this modification of the present invention, a player may have the option to take the printed payoff value or to play automatically for the higher or lower value.

Fixed Payoff Embodiment

The disclosed Pachinko bonus game and/or the stand-alone Pachinko game discussed above, in this embodiment, provides fixed payoff values 260 for lanes L1–L8 which could be printed at each lane or displayed in displays 250. Hence, the payoff values remain the same from game-to-game. Of course, this embodiment is subject to mechanical bias.

Bonus Game with Themed Play

Figure 8:
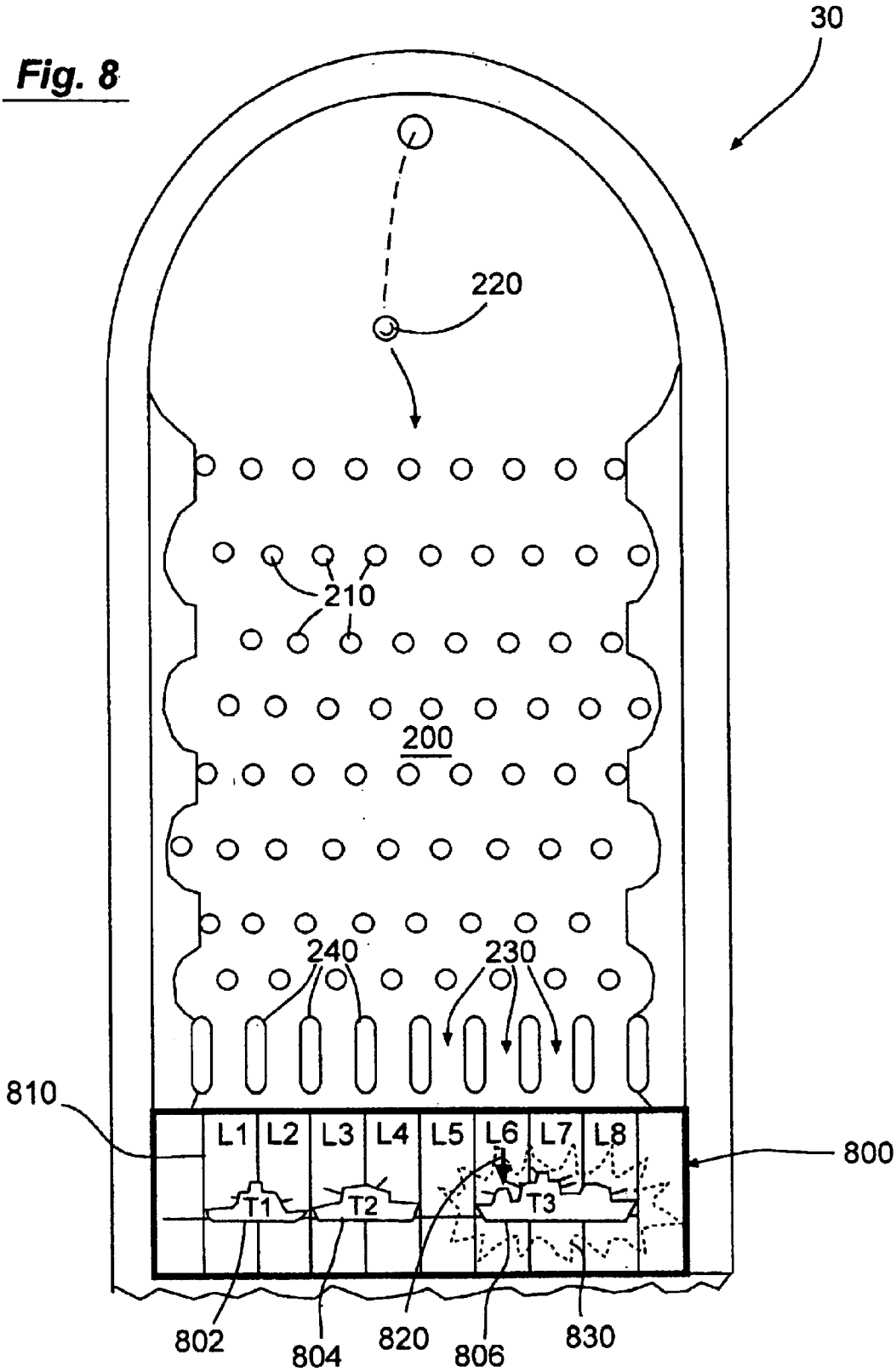
FIG. 8 illustrates another embodiment of the Pachinko bonus game of the present invention.

A bonus feature utilizing the Pachinko top-box 30 themed to a casino game, such as the well known BATTLESHIP game from Hasbro as shown in FIG. 8 is illustrated herein. A casino version of the BATTLESHIP game is found in U.S. Pat. Nos. 6,398,644 and 6,645,071 incorporated herein by reference. Any suitable theme could be utilized. In the BATTLESHIP game, ships are targets to be hit or to be missed. Any other suitable target or object to be avoided can be utilized under the teachings of the present invention based upon any suitable theme. As an example of the latter, avoiding hitting an object, such as a tree, during play of the game results in an award.

The bonus display 800 can be a video screen display (or any suitable display whether electronic or mechanical) mounted behind or below the field 200 so that the ball 220 can travel over or up to the edge of the screen. The dividers 240 can physically extend all the way down to the bottom over the video display 800 (or only partially). Alternatively, the dividers 240 can be adjacent to the video display 800. The video display 80 can have etched or painted on lines 810 to simulate the continuation of the physical division of dividers 240 or can be graphically shown as part of the video presentation. In the situation where the display 800 is a video display, the targets T (T1–T3) such as ships 802, 804, 806 can be stationary at a lane L (L1–L8). Or, the targets T can have moving effects such as caused by wave action from water. Or, the targets T can actually be moving across the lanes L in the bonus display 800. Note furthermore that each target T may occupy one lane or more than one lane. In one embodiment, a target occupying more than one lane occupies a plurality of adjacent lanes, such as a boat whose length occupies, e.g., three lanes. Furthermore, when the ball 220 "hits" a target as shown by arrow 820, a game response indication 830 such as a visual effect and/or other suitable display such as an exploding noise and an explosion visually shown on display 800 can occur to add more excitement to the game. In other embodiments, the display 800 can be any suitable mechanical or electrical/mechanical display that displays the target T in a stationary fashion or in a moving fashion.

Bonus game play is initiated through a qualification condition in the underlying casino game machine game 20. A large number of conventional conditions can occur such as a bonus trigger symbol appearing. The top box 30 includes the Pachinko playfield 200 with a display 800 that indicates whether each lane 230 is empty or whether it has a "target" T such as an enemy ship 802, 804, 806 located therein. The object of the game in FIG. 8 is to drop the ball 220 from an opening 840 and have it "hit" a target T such as an enemy ship 802, 804, 806 by passing through a lane 230 having an enemy ship. If instead the ball 220 drops through an empty lane (such as lane L5 in FIG. 8) this is a "miss." The hole 840 is sized to allow the ball 220 to pass through. Behind the field 200 is a vertical "escalator" (tube) of balls driven by a mechanical motion, not shown.

In FIG. 8, ship 802 occupies lanes L1 and L2, ship 804 occupies lanes L3 and L4, lane 5 is empty and ship 806 occupies lanes L6, L7, and L8. Hence, when ball 220 travels through lane 5 it travels through an empty lane and this is a miss. However, if ball 220 travels through lane 8, ship 806 is hit. If ball 220 travels through lane 3, ship 804 is hit and if ball 220 travels through lane L2 ship 802 is hit. With each successive hit (or stage of play), the top-box lighting and background audio/visual effects will "heighten" in intensity and frequency to increase suspense.

As the bonus game of FIG. 8 initiates, the display 800 indicates an enemy ship (802, 804, 806) at lanes L. In one embodiment, the first "shot" (ball 220 dropped) will always be a hit (as a ship is always at a lane) and serves to provide the player with a minimum bonus level or award. In another embodiment, one or more lanes are empty as shown in FIG. 8.

Figure 9:
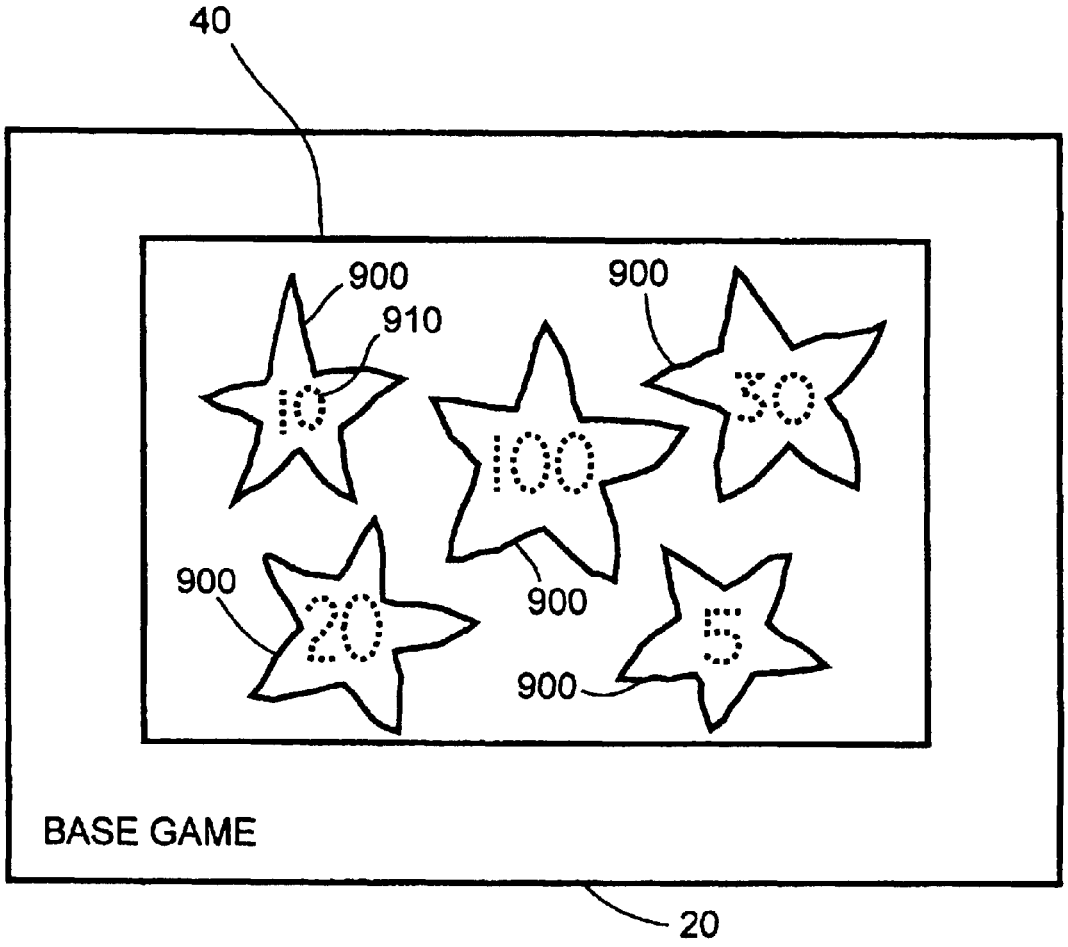
FIG. 9 is a front view of the base game screen showing random objects.

After each hit, the video screen 40 (on the base game 20) changes to display a set of "objects" 900 based on the "stage" of battle as shown in FIG. 9. For example, for "Stage 1 Complete" the player might choose from "objects" 900 such as seashells, while other stages might display starfish, coconuts, palm trees, etc. The player is prompted to choose an object 900 which then reveals a hidden award 910. The awards are shown in dotted lines in FIG. 9. Thereafter, (for the next stage of the bonus game) the hit ship (802, 804, 806) is removed (extinguished in the top box display 800), and the remaining ships are shuffled (randomly, in one embodiment or orderly, in another embodiment) and reassigned to be at lanes L prior to the next "shot." Alternatively, the player might "advance" to the next battle scenario and a new set of ships might be assigned to lanes L prior to the next "shot." The bonus game of FIGS. 8 and 9 ends when the player's shot is a miss (e.g., the ball traverses a lane that is empty).

It is an advantage that the player generally takes multiple shots during the bonus game, each hit resulting in the next stage of bonus play. Too, as the potential awards for each Stage grow, and yet the chance of success slowly diminishes, the suspense also grows for the player with each successful shot.

The following average pay schedule is exemplary for 8 stages of play:

| Hit # | Award |
|---|---|
| 1st | 25x |
| 2nd | 10x |
| 3rd | 20x |
| 4th | 40x |
| 5th | 60x |
| 6th | 80x |
| 7th | 125x |
| 8th | 500x |

Based on a Monte Carlo simulation of the bonus game, the following is obtained:

EV (Expected Value)=85.3

Average number of shots=4.25

For example, if a "starfish" object is selected, the selected starfish value would have an average value of 25× for the first hit (e.g., {15×, 20×, 25×, 30×, 35×}, an average value of 10× for the second hit (e.g., {5×, 10×, 10×, 10×, 15×}, etc. As an alternative, ships may be portrayed some of which are the enemy (to be hit), some of which are friendly (to be avoided). The status of lanes may be such that four lanes are enemy occupied, three lanes are friendly, and three lanes are vacant. "Shooting" a friendly ship (i.e., "end-of-game" target in at least one lane) ends the bonus game, "shooting" an enemy ship (i.e., a target) yields an award, and "shooting" an empty lane results in another shot being awarded.

To avoid any physical bias that may be introduced into the equipment, the ships and vacant lanes are randomly positioned in one embodiment such that each lane has an equal likelihood of containing a ship or being vacant. For example, consider a casino game with 10 lanes L, one of which is to be vacant and nine of which are to have a "ship" occupy the lane. To preserve fairness to the house and to the player even in the case of mechanical bias in the Pachinko equipment, the placing algorithm should be such that each of the 10 lanes is equally likely to be vacant (and hence, each of the 10 lanes is equally likely to have a ship). In practice, this may be done by first randomly choosing which lane shall be vacant (say, lane L4), and then subsequently "filling in" the other lanes with ships of varying sizes (e.g., a ship filling in three lanes, a ship filling in two lanes, and a ship filling in four lanes).

As an alternative, to add suspense, prior to each shot, one of the remaining ships may be selected to randomly display a special effect such as blinking, being lit, having a value, etc. Should this ship be sunk, the resultant award may be increased, for example, tripled.

Figure 10:
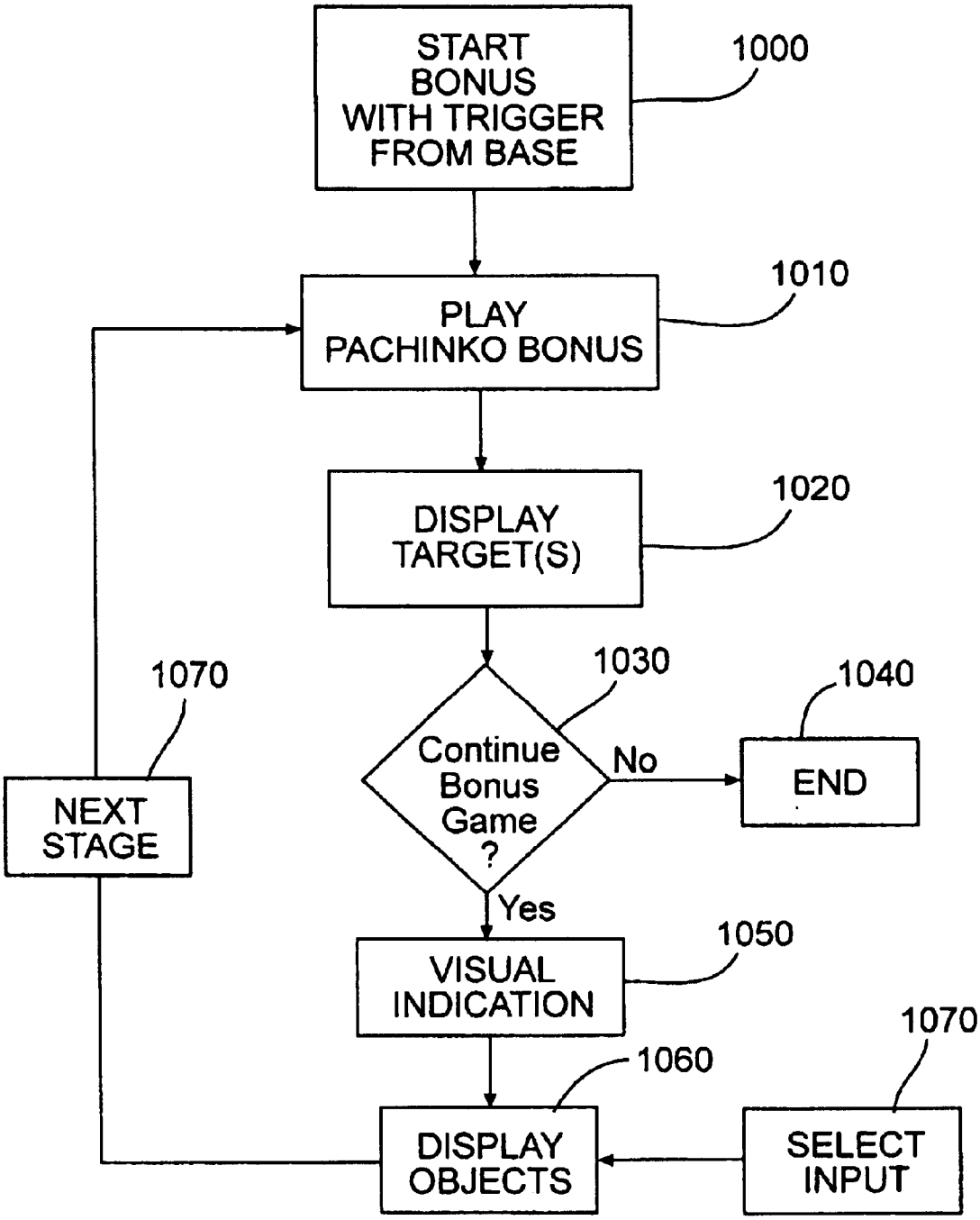
FIG. 10 is an operational flow chart for the bonus game of FIGS. 8 and 9.

The method steps implementing the bonus game described above in software are shown in FIG. 10. The bonus game starts in any conventional fashion from the base game 20 in step 1000. The Pachinko bonus game of FIGS. 8 and 9 is then enabled for play at 1010. Play of the Pachinko bonus game can occur either through the player launching the ball 220 or an automatic launch with or without multimedia effects. The "target(s)" T are displayed in display 800 in step 1020. The ball 220 is launched and travels through the playing field 200 as described above and passes through one of the lanes L to hit (or miss) a target T such as a ship 802, 804, or 806. The detection of a hit occurs in step 1030 and is computer determined in one of any number of different ways. For example, the sensors (discussed above) can be utilized to sense which lane L the ball passes through, and the computer, in software, determines which segment of the display 800 corresponds to the traveled through lane so that the computer can determine whether or not a hit has occurred on a target T. If there is no hit in step 1030 then the bonus game ends in step 1040. As mentioned above, and in one embodiment, when the target(s) are displayed at 1020, for the initial launch of ball 220, a target T occupies each lane, thereby assuring a hit 1030. In this embodiment, a hit on a target T occurs at step 1030, the bonus game continues, and a corresponding visual indication 830 is given at step 1050 which can be any suitable audio/visual effect and, if paid, any suitable award such as set forth above in the payout table. If an end-of-game hit on a friendly target is determined 1030, then the bonus game ends 1040. If the ball travels through a lane with no target, then in one embodiment a new ball is propelled in step 1070 and in other embodiments the game ends 1040. The method is vigorous and the many design methods taught herein can be implemented.

In one embodiment, bonus game play continues so that step 1060 is entered to display a set of objects 900 in the base game display 40 as shown in FIG. 9. Here, the player is afforded the opportunity to select in stage 1070 by touching (or other input) one of the displayed objects 900 so that it can reveal an additional award for the next stage play. This continued interaction of the player with the base game display 40 is optional.

The "next stage" is entered at step 1070, and play of the Pachinko bonus game 1010 continues with new targets T 1020 displayed. As mentioned above, and in one embodiment, the target T hit in the prior play is removed from the remaining targets T and the remaining targets are randomly shuffled and displayed across the lanes L. In this embodiment, with a target T removed, more lanes are empty, thereby increasing the possibility that play will end at step 1040 with a miss when the ball travels through an empty lane L. In another embodiment, the same targets T are randomly shuffled and displayed. In another embodiment, entirely different targets T are displayed in each new stage with or without the same number of targets for each next stage. It can be appreciated that the game is vigorous at this point with many possible embodiments. Play continues according to FIG. 10, until the ball 220 travels through a lane L that is empty and the game ends at 1040. The sequence of "hits" might lead to a jackpot award if there are no misses. Or, it might lead to a progressive award, etc.

In another embodiment of the present invention, more than one ball 220 can be launched either sequentially or simultaneously so as to provide for more possible hits in a single play of the Pachinko bonus casino game disclosed herein.

The playing field 200 can be any playing field and is not limited to the type shown in FIG. 8. Any conventional playing field or future playing field can be utilized with the lanes L to display in display 800 at least one target T. According to the teachings of the present invention, this display 800 provides the opportunity to add further excitement to the play of the ball on a playing field wherein the ball would exit through a plurality of lanes to either hit a target or to miss a target according to the discussion contained herein.

The term "underlying casino game machine" shall be any mechanical, electronic, or video slot machine, any casino base game whether or not a slot machine, etc. The definition is vigorous and is not meant to limit the invention to past, present, or future gaming machines.

The terms "hit" and "miss" are used to mean the presence (or non-presence) of a target T at the lane the ball 220 travels through. The ball 220, of course, does not literally hit a target, but the correspondence of the ball and the target "at" the same lane L by the computer constitutes a "hit" to the player which results in the award of a payout. The term "at" used above means above the lanes L, in the lanes L, behind the lanes L, near the lanes L, or below the lanes L.

Furthermore, the bonus game disclosure herein can be adopted for a stand-alone Pachinko game as fully discussed earlier in this application. Such a stand-alone Pachinko casino game would be initiated upon placing a wager (rather than being initiated upon the occurrence of a bonus condition). In this embodiment, the targets T are randomly displayed and disposed at a plurality of lanes L wherein more lanes are empty (i.e., not having an associated target present when the ball travels through a lane) so as to obtain more misses.

It is to be expressly understood that FIG. 8 shows targets T that are at more than one lane. Targets T can be utilized under the teachings of the present invention that are at only one lane.

The above disclosure can be implemented in a wide area progressive. As an example, with a playing field having a row of eight lanes, the probability of sinking all eight ships is 0.0024 (approximately 1 in 416) for eight successive shots. As such, with a base symbol probability of 0.0000416 (approximately 1 in 24,033), the overall probability of winning the wide area progressive is set to approximately 1 in 10,000,000 utilizing a dual-stage qualification (1/416×1/24033). This gives players more of a "taste" of almost winning compared to traditional wide area progressives. Each ship occupies only one lane. The casino bonus described in this example has up to eight "shots" (i.e., eight separate launches of a ball). The first shot is with 8 ships (hence a sure hit). The next shot is with seven randomly placed ships, then 6, 5, 4, 3, 2, and finally 1 ship. In each case, the lanes with ships/vacant are randomly assigned.

Bonus Game with Mathematical Computation

Figure 11:
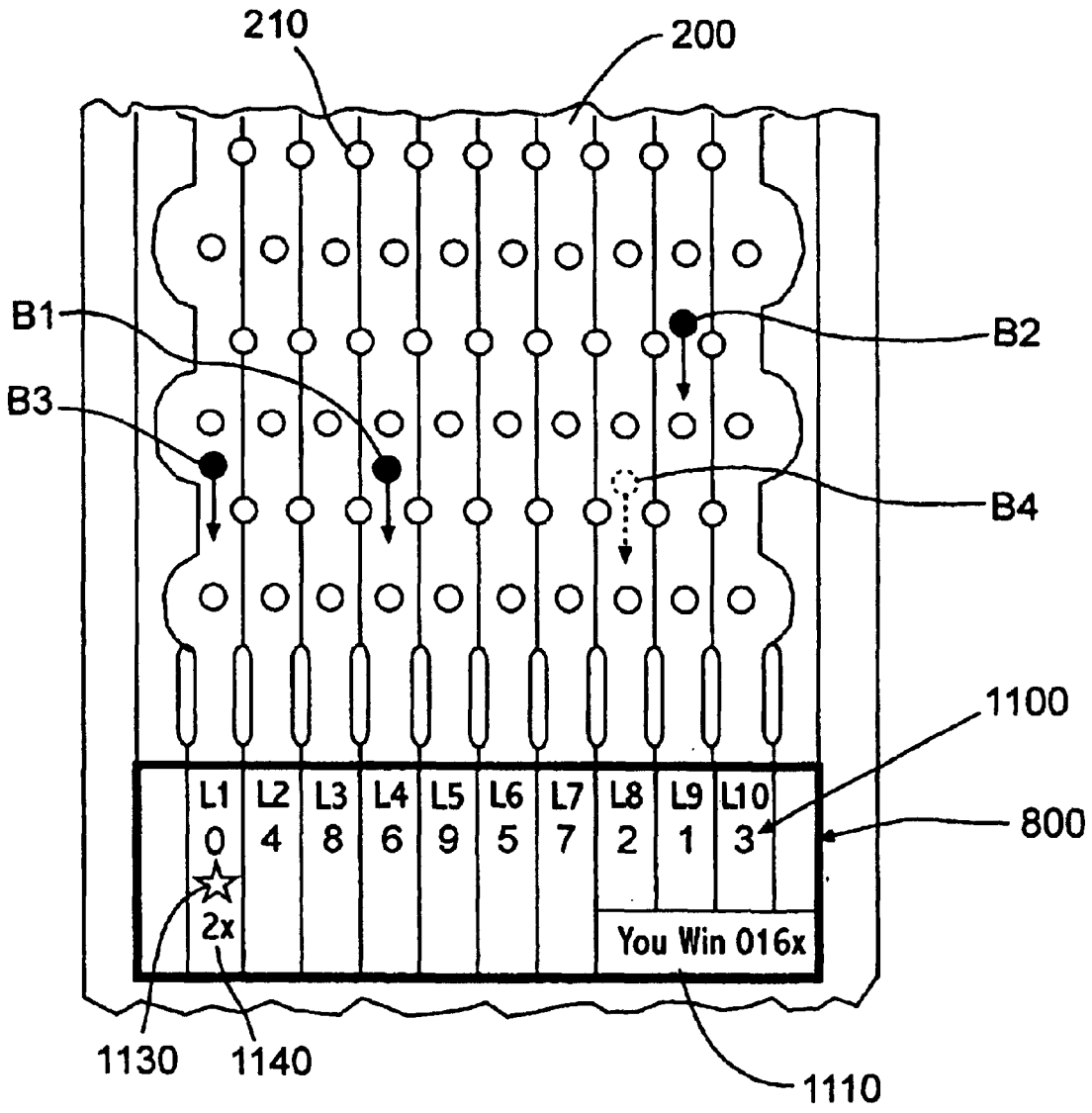
FIG. 11 is an embodiment of the present invention showing three sequential balls selecting digits of a decimal number.

In another embodiment shown in FIGS. 11 and 12, the casino bonus game plays as follows. Upon the initiation of a bonus condition, as previously discussed, the player receives a predetermined number of balls which are propelled onto the playing field 200. In FIG. 11, three balls are shown, B1, B2 and B3. The display 800 randomly displays a series of numbers when a player of the bonus game begins. In this embodiment, there are ten lanes L1 through L10 and a series 1100 of random numbers from zero through nine corresponding to the single digits of the decimal system are displayed in the ten lanes. In this example, ball B1 is launched first and goes through lane L4 in which the number six is randomly displayed for the "units" decimal placement. Then ball B2 passes through lane L9 in which the number one is randomly displayed for the "tens" decimal placement. Finally, ball B3 is delivered through lane L1 corresponding to the random number zero for the "hundreds" decimal placement. The sequence of ball activation results in a decimal number of "016." Hence, the award to be given the player is a function of the number "016." For example, if the player had wagered two units as a bet to play the underlying casino base game, then the award in the bonus game would be 32 units as "016" is used as a multiplier. In a multi-line game, the initiating line bet may be considered the bet. In another variation, the decimal number "016" could be the actual award in units.

Indeed, under the teachings of this embodiment, more balls such as the optional ball B4 could also be delivered to provide the "thousands" decimal placement, etc. The game response indication for this win is shown as 1110 and can be used to increment a credit meter or the like.

In another embodiment, the three balls generate three numbers (e.g., 1, 4 and 6), and the player is awarded the maximum number thereby created (e.g., 641) multiplied by an initiating bet (or 641 units are awarded).

Figure 12:
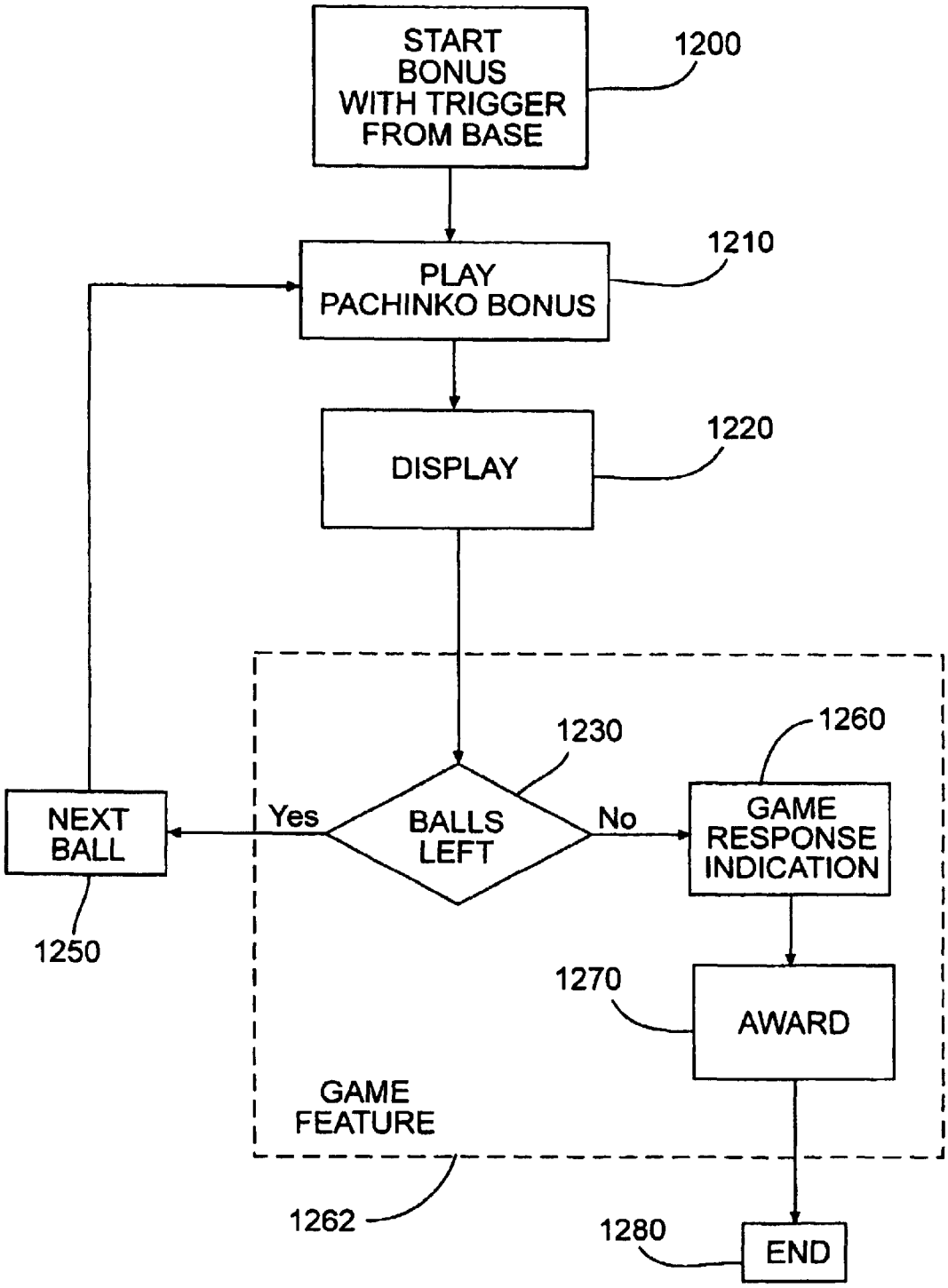
FIG. 12 sets forth the operational flow chart for the bonus game of FIG. 11.

In FIG. 12, the method of the present invention for the aforesaid embodiment is set forth. The bonus game starts 1200 with a suitable bonus initiate condition such as a trigger from the base game. The bonus game is then played in stage 1210. Here, the single digit series 1100 of numbers are randomly displayed at each of the ten lanes L1 through L10 which is shown in stage 1220 to the player. The ball is launched, as discussed, and this can occur at any suitable time. In stage 1230, the ball is sent traveling through one of the lanes and an internal ball counter is incremented in the computer control. Hardware and software counters are well known in the computer arts. The next sequential ball 1250 is delivered and the display 1220 displays the prior randomly assigned numbers. In another variation of this embodiment, a new set of digits could actually be randomly displayed. In stage 1230, the counter is incremented by one and the process described above repeats until no balls are left. When that occurs, stage 1260 is entered which provides the game response indication 1110. It is to be expressly understood that the game response indication 1260 can be shown incrementing with each passing ball in stage 1230. It should be noted that the indicator 1110 may be a common display for the base game, with an alternative depiction when in bonus mode. In this example, when the pre-determined number of balls have fully been launched and travel through lanes, the game response indication is a number such as "016" read discussed above. An award 1270 is provided based on the indication 1260 such as the number read or the maximum number based on the number read. The bonus game is now ended in stage 1280.

In another embodiment of FIGS. 11 and 12, one or more of the lanes have indicators which offer different meanings. For example, the third ball B3 dropped may include, within one of the lanes, a symbol depiction of a star which provides a "zero" number, but enables another ball launch. If the ball B3 drops into the star lane, then the hundreds digit becomes a zero, and a fourth ball B4 is dropped to depict the thousands digit. In this manner, the player enhances his/her win if the star lane is selected. With reference to FIG. 11, the star 1130 is shown in lane L1. This embodiment provides an award of B1=6, B2=1, B3=0 (enables ball B4), and B4=2. The award is 2016. In another embodiment, selection of a "2×" lane by any of the balls automatically doubles the total win amount. For example in FIG. 11, if ball B1 hits L4 and a "six" is read. Then ball B2 hits L9 an a "one" is read. Then ball B3 hits L1 with the 2× symbol 1140, and a "zero" is read, but the final award is doubled. So, the number read is "016" and the award is doubled to 32. Any suitable graphic symbol could be provided other than a "star" or "2×" to perform an added game feature on the read number such as a new ball launch, a mathematical operation such as 2×, etc. As shown in FIG. 12, the added game feature 1262 is implemented under computer control to detect the presence of any displayed graphic symbols in a lane that a ball travels through.

Figure 13:
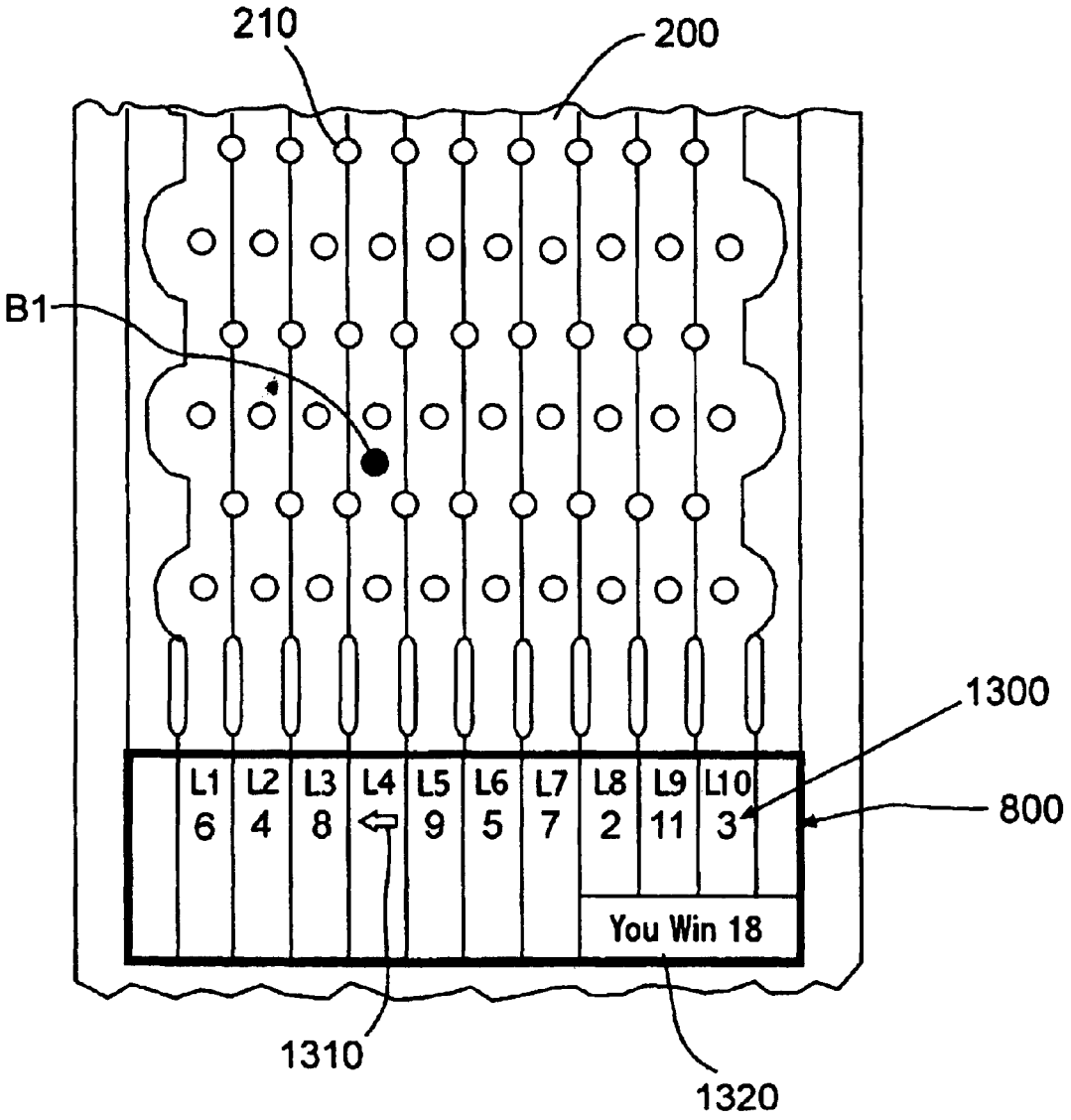
FIG. 13 is an illustration of embodiment of the present invention showing a graphic controlling a mathematical computation to generate an award.

In yet another embodiment shown in FIG. 13, particularly suited to the embodiment in which numerical award values 1300 are depicted in each lane, one or more lanes act as "sweeps". For example, one of the lanes (lane L4 in FIG. 13) could have a "left arrow" picture 1310. If the ball B1 drops into this lane L4, the player would win the computed sum of all values to the left of this lane. The total in this example is 18 and this is shown in the indication 1320.

Figure 14:
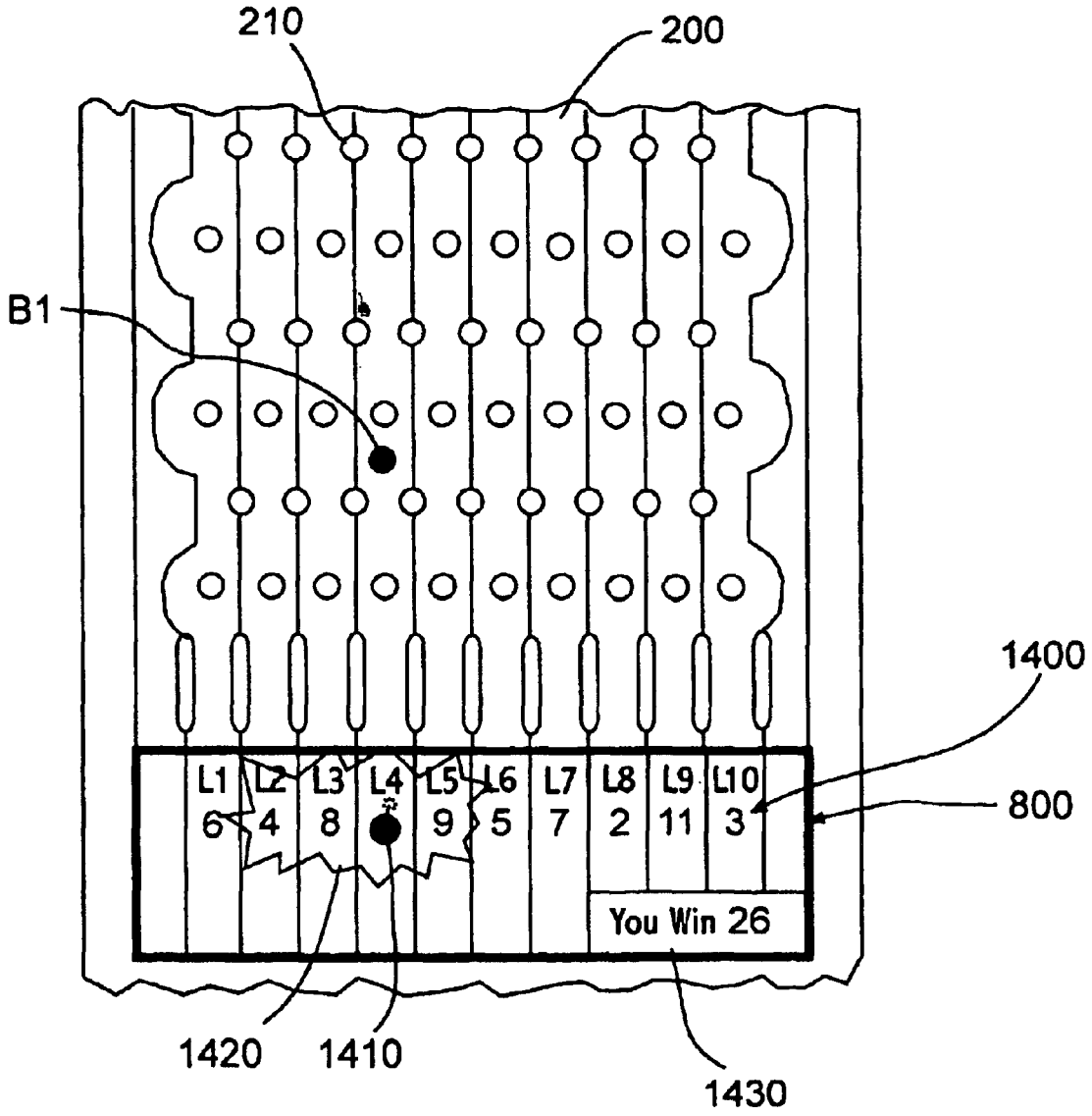
FIG. 14 is a variation of the embodiment shown in FIG. 13.

Another lane might have a "bomb" picture 1410 as shown in FIG. 14. If the ball B1 drops into this lane L4, the bomb graphically explodes 1420, giving the player an award computed with the values affected by the explosion 1420. In FIG. 14, the computation could be the sum of L2=4, L3=8, L5=9, L6=5 or "26" which is displayed indication 1430. The computation could be multiplication in which case 4×8×9×5 is awarded. In each case, a ball falling into one of the lanes causes a suite of values to be involved in the computation and be awarded to the player. The explosion 1420 could be some or all values 1400.

In the above two examples of a directional arrow 1310 and bomb 1410, a graphic is displayed in one (or more) of the lanes L and if the graphic is hit by the ball, a predetermined mathematical operation based on the graphic occurs. In the case of FIG. 13, the mathematical operation is the summation of the numerical values displayed to the left of the arrow 1310. In the case of a bomb in FIG. 14, a topological area 1420 is displayed in which the values are summed. Various mathematical operations may be performed on the values within area 1420, including summation, multiplication, and/or other mathematical operations. Any suitable graphic could be utilized under the teachings of the present invention.

Figure 15:
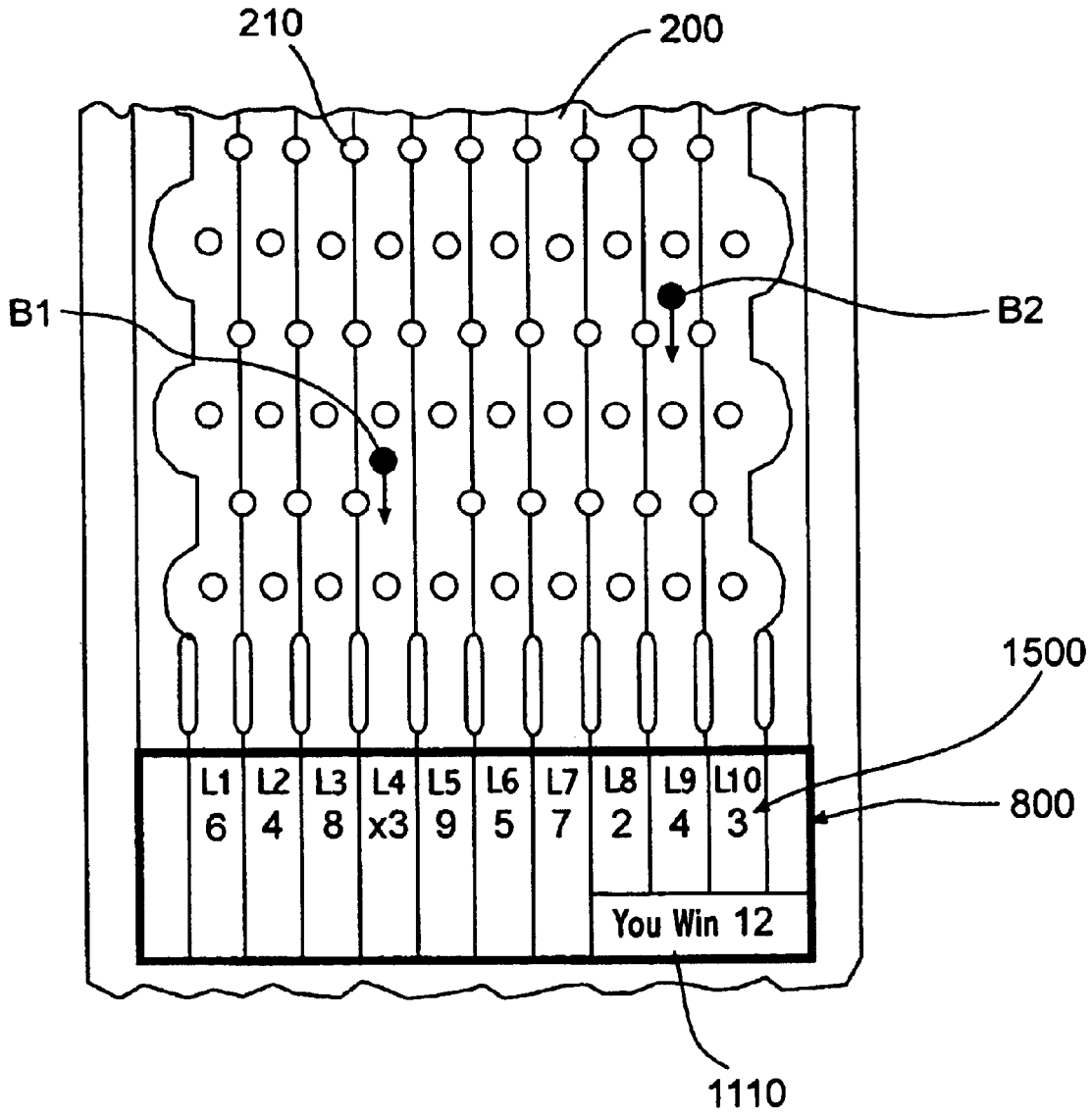
FIG. 15 sets forth a variation of the embodiment of FIG. 13.

In still another embodiment shown in FIG. 15, particularly suited to the embodiment in which numerical award values 1500 are depicted in each lane, one or more lanes have a multiplier designation of a set amount (e.g., ×3 in L4). Should the ball B1 land in the multiplier lane, values in each remaining lane are tripled. When a ball B2 is then dropped through lane L4 having a value of 4, the player's award is computed to be 3×4 or 12 (again, the "12" could be used as a multiplier of a bet or the award of units).

While the embodiments of FIGS. 8–15 show features of a casino bonus game, it is to be expressly understood that these game features could be implemented into a stand alone casino game, a casino game played over the internet, or a scratch lottery type of game.

Figure 16:
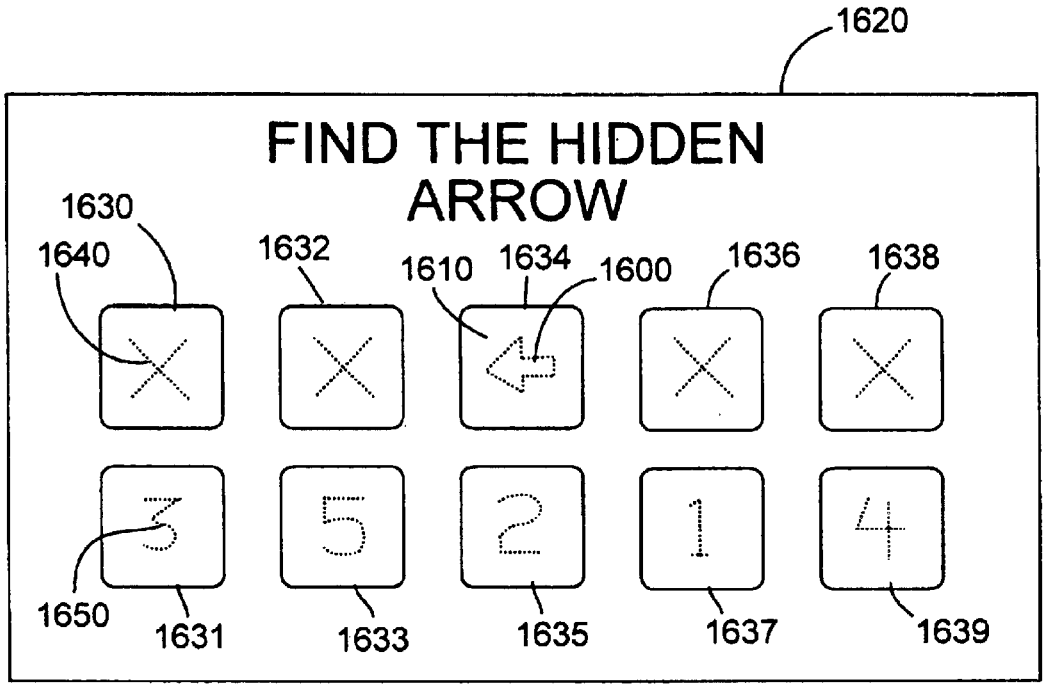
FIG. 16 sets forth a scratch lottery ticket embodiment of the embodiment of FIG. 13.
Figure 17:
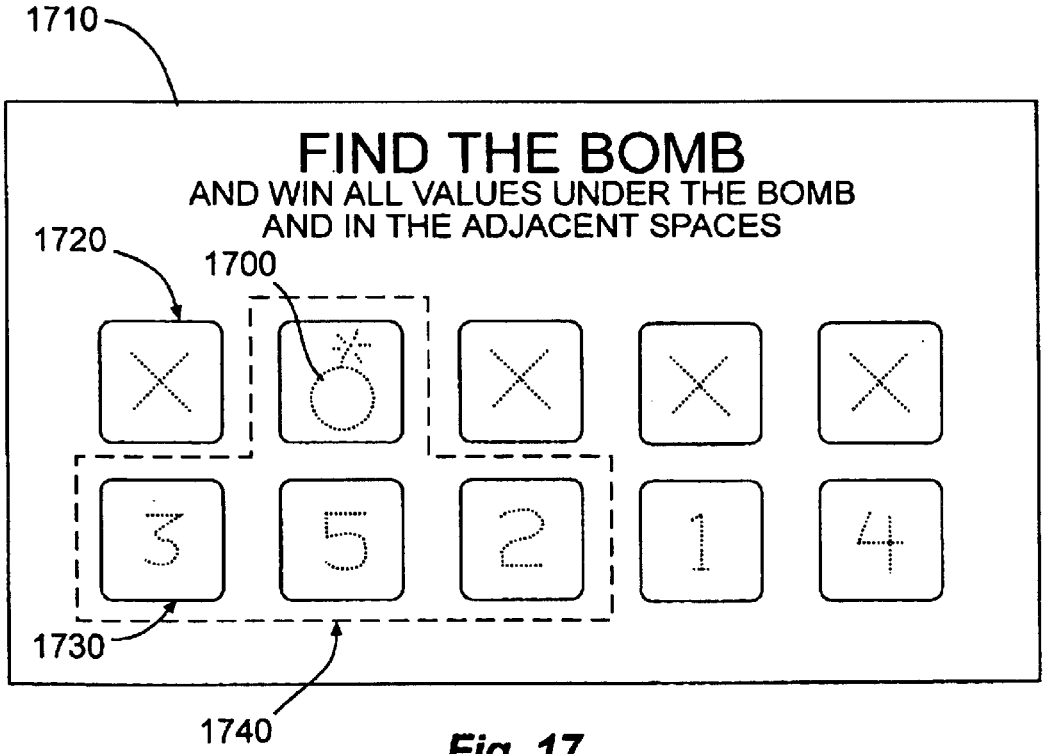
FIG. 17 is a scratch ticket variation of the embodiment of FIG. 14.

The latter is shown in FIGS. 16 and 17 but could be utilized throughout the disclosure above. For example, in FIG. 16, a graphic arrow 1600 is hidden below a scratch play area 1610 of a scratch lottery ticket 1620. Each of the five play areas 1630, 1632, 1634, 1636, 1638 are covered with conventional material that can be scratched by a player to reveal a hidden symbol 1600 (i.e., arrow) or 1640 (i.e., X). Underneath each scratch play area is a corresponding scratch award area 1631, 1633, 1635, 1637, and 1639. Each scratch award area has a value 1650 (usually in dollars). In the play of the scratch lottery game of FIG. 16, the player can only scratch one of the play areas 1630, 1632, 1634, 1636, and 1638. Scratching more than one play area 1610 would invalidate the ticket 1620. If the player scratches a scratch play area that does not contain the arrow 1600, the game is over as the player will reveal a symbol such as "X" 1640. On the other hand, if the player scratches a play area such as 1634 to reveal the directional symbol such as arrow 1600 then the player would win the value in the scratch award area 1633 under the arrow ($2.00 at 1633) plus the awards under areas 1631 and 1632 ($3.00 at and $5.00 at 1632) which would be also revealed by scratching. Hence the player wins $10.00.

FIG. 17 shows the implementation of the directional symbol being a bomb graphic 1700 into a lottery ticket 1710. Scratching any of the other play areas 1720 to reveal the "X" would result in no award. However if only the play area 1720 containing the bomb 1700 is scratched, then the player would scratch the award area 1730 directly under the bomb 1700 and the adjacent award areas on either side. In the example of FIG. 17, the player would scratch 5, then 2, then 3 to win an award of $10.00. The area scratched is shown by 1740.

What is described above in FIGS. 16 and 17 is a scratch lottery ticket having a plurality of scratch play areas wherein one of the scratch play areas has a directional symbol such as arrow 1600 or bomb 1700. The directional symbol directs the player, based on information contained on the ticket, as to which scratch award areas are now to be scratched and uncovered. The award areas that are scratched pursuant to the instructions on the ticket pertaining to the directional symbol are then summed and awarded.

Bonus Game Interacting with Base Game

Figure 18:
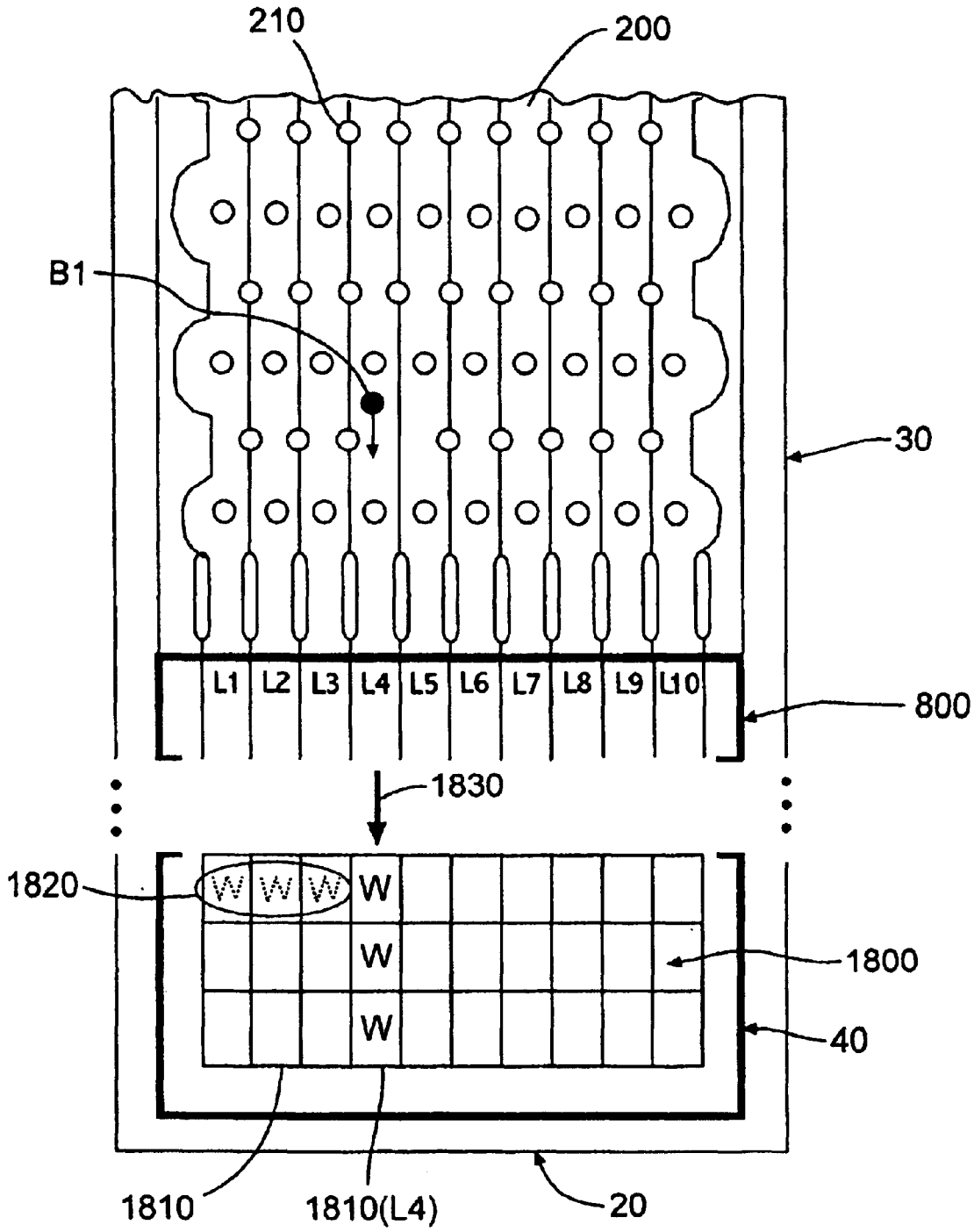
FIG. 18 sets forth an embodiment of the present invention wherein the bonus game interacts with the base game.

The above embodiments of FIGS. 8–15 can also be implemented to affect the underlying casino game 20 such as a conventional multi-reel, multi-pay line video slot game. In the example of FIG. 18, the ten lanes L1–L10 are used, but the lanes would match a corresponding number of vertical columns 1810 in the display 40 of the base game 20. When a bonus feature occurs in the casino game of FIG. 18, the ball B1 is delivered and passes through a lane such as lane L4 and then is graphically shown to sweep all of the symbols in the corresponding column 1810 (L4). The timing is implemented by the computer control. When the ball B1 passes through lane L4, the screen column 1810 (L4) is caused to graphically show the ball B1 traveling through the column as shown by arrow 1830 and to convert all displayed game outcome symbols to a wild symbol W. The player then receives payouts for any winning combinations in the game outcome 1800 displayed with the column 1810 (L4) converted to wild symbols W. In one embodiment, the appearance of a graphic such as arrow 1310 (FIG. 13) could cause all game outcome symbols in row 1820 to become wild. Likewise, if ball B1 passes through a lane that has a bomb symbol, game outcome symbols within a predetermined area on the video screen 1800 would become wild through an explosion symbol.

Figure 19:
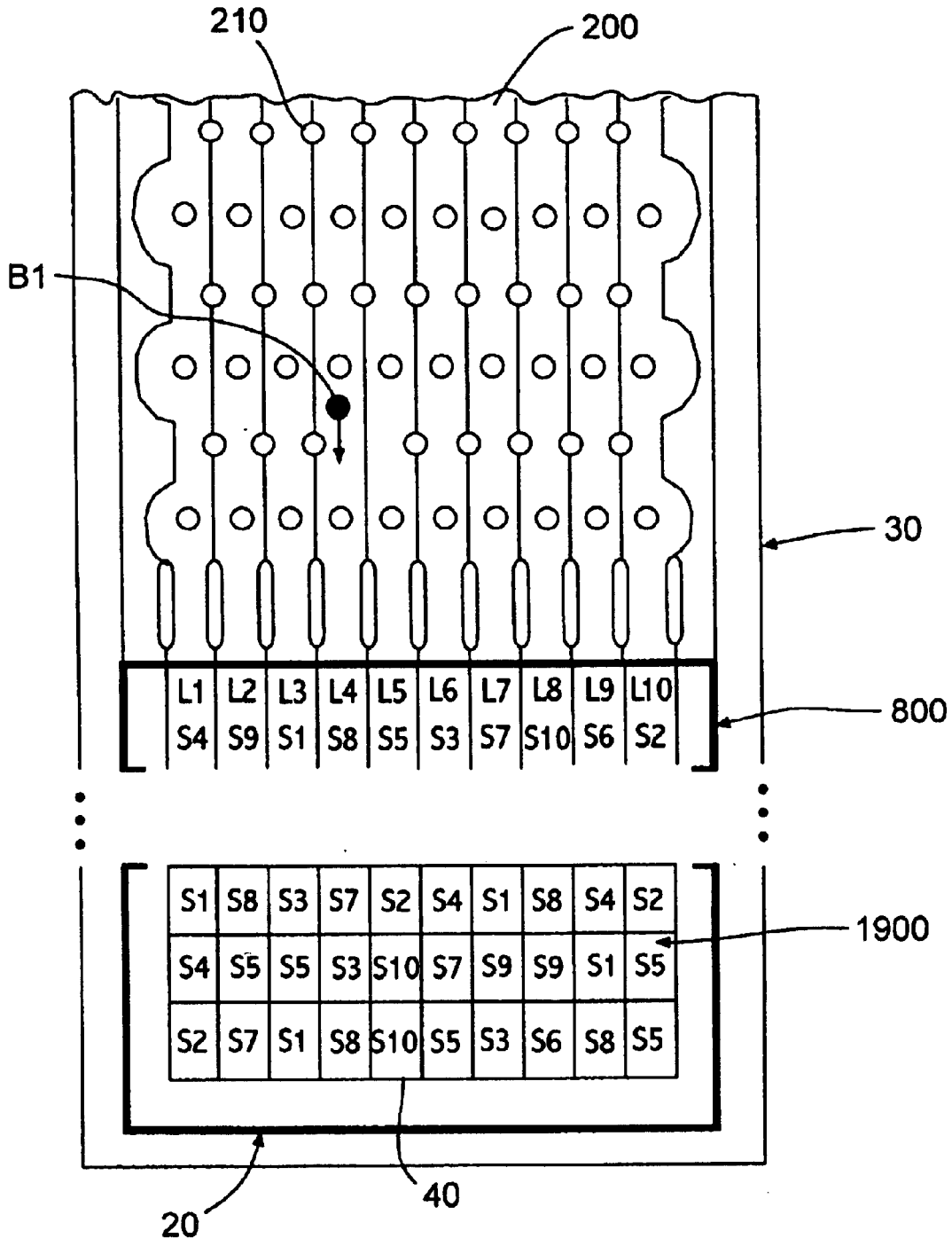
FIG. 19 sets forth another embodiment wherein the bonus game interacts with play of the base game.

FIG. 19 shows another variation of the Pachinko bonus game interacting with the display 40 of the underlying base game 20. In this embodiment, the ball B1 travels through lane 4. In the display 800 of the bonus game 30, at least one of the randomly displayed symbols S1–S10 appears in at least one of the lanes L1–L10. In the example of FIG. 19, each lane has a different randomly displayed symbol. This embodiment is vigorous in that the lanes L1–L10 could be variously configured. In one variation, some of the lanes could have award values, and some of the lanes could have symbols. Or, in another variation, only certain of the symbols used in the play of the underlying casino game appear in the lanes.

These symbols are the conventional symbols that may also be displayed in display 40 in the reel spin as a game outcome shown as 1900. The game outcome in the underlying casino game is based on these symbols. Some or all of these symbols may appear in the game outcome. This is a conventional game outcome, and the symbols S1–S10 are conventional and can comprise any desired symbol. The designations S1–S10 are only used to illustrate the embodiment of the present invention. The ball B1 travels through lane L4 which corresponds to a randomly displayed symbol S8. As soon as the ball B1 travels through lane L4, it is sensed, as discussed above. Then, all S8 symbols in the displayed game outcome 1900 are changed to a wild symbol W. Any payout to the player is based upon the game outcome with all S8 symbols converted to wild symbols. This adds excitement and increases the possible award based upon the game outcome 1900 with the converted wild symbols.

Figure 20:
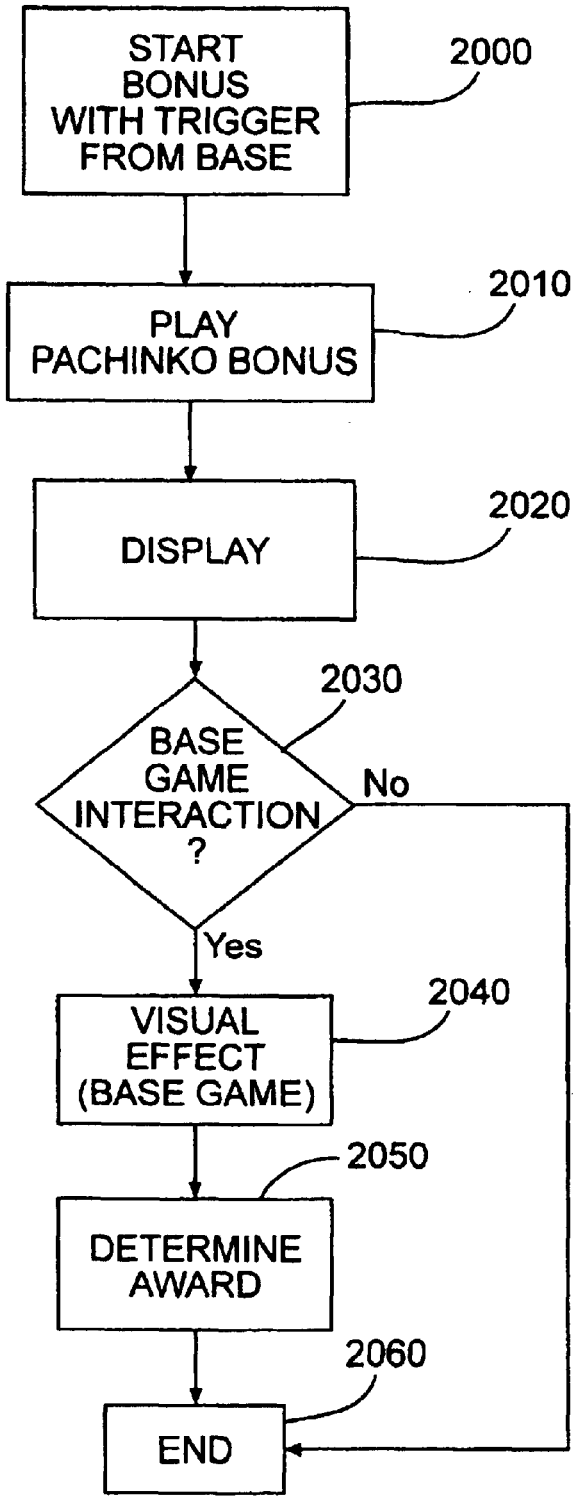
FIG. 20 sets forth an operational flow chart for the bonus/base interaction games of FIGS. 18 and 19.

In FIG. 20, the flow chart for the examples of FIGS. 18 and 19 providing base game interaction is shown. In FIG. 20, the bonus game 30 is started 2000 as before. The ball B1 is propelled on to the playing field 200 among the pegs 210. The display stage 2020 is optional in FIG. 18 but in FIG. 19 the display stage 2020 randomly displays symbols S1–S10 (in the case of the above example). The display stage 2020 displays the symbol or symbols randomly in one, some, or all (i.e., at least one) of the lanes L1–L10. In stage 2030, a base game interaction determination is made. For example, in FIG. 19, S8 is a displayed symbol in the game outcome shown in game outcome 1900. Hence visual effects 2040 now occur in the display game outcome 1900 by converting all symbols "S8" to a new wild symbol "W" (in the case of the example). In the event ball B1 goes through a lane containing a symbol that is not displayed in the game outcome 1900 (or in variations of this game, a lane not having a symbol that interacts with the lower base game), then the game is over with in stage 2060. It is to be expressly understood that the ball may travel through a lane and thereby provide an award in which case the game ends 2060 with the award being given to the player. In the event the base game interaction is detected in stage 2030, stage 2040 is entered, and the visual effects occur as discussed. This could be the all symbols column 1810 (L4) in FIG. 8 becoming wild W or any other suitable visual effect based upon the teachings contained herein. Stage 2050 is then entered to determine the award based upon the modified game outcome (1800 or 1900) with the converted wild symbols W. The game then ends at 2060.

In this embodiment, the Pachinko bonus game is used to generate wild symbols in the underlying casino game.

The various Pachinko bonus embodiments shown in FIGS. 8–15 and 18–20 are preferably contained within a single enclosure such as a separate mechanical top box 30 to electronic base game 20, as shown in the listed figures. The Pachinko bonus embodiment can also be incorporated into the screen 40 and played electronically with the Pachinko field and ball graphically shown.

The above disclosure sets forth a number of embodiments of the present invention. Those skilled in this art will however appreciate that other arrangements or embodiments, not precisely set forth, could be practiced under the teachings of the present invention and that the scope of this invention should only be limited by the scope of the following claims.

We claim:

1. A casino bonus game for an underlying casino game machine, said casino bonus game comprising:

a playing field;

a ball, said ball propelled onto said playing field when an initiate condition occurs during the play of said underlying game;

a row of lanes on said playing field, said ball after traversing said playing field traveling through one of said lanes in said row;

a display at said row of lanes on said playing field for displaying at least one target across a plurality of said lanes;

a game response indication when said ball travels through said one lane, said game response indication being an award when said at least one target is hit.

2. The casino bonus game of claim 1 wherein said at least one target is randomly displayed.

3. The casino bonus game of claim 1 wherein said at least one target has a payoff value different from lanes not having said at least one target.

4. The casino bonus game of claim 1 wherein said casino underlying game machine is a slot machine, said slot machine having a plurality of reels and a payline.

5. The casino bonus game of claim 4 wherein said initiate condition occurs when a bonus game symbol appears on said payline during the play of said slot machine game.

6. The casino bonus game of claim 1 wherein said initiate condition is an accumulated value based upon said play of said underlying game machine.

7. The casino bonus game of claim 1 wherein the at least one target is a plurality of targets, and wherein at least one of the plurality of targets displays a special effect; when said one target displaying the special effect is hit, then increasing said award.

8. The casino bonus game of claim 1 wherein the at least one target moves across lanes in said row.

9. The casino bonus game of claim 1 wherein said display further randomly displays at least one end-of-game target in at least one lane in said row, said casino bonus game ending when said end-of-game target is hit.

10. The casino bonus game of claim 1 wherein when said ball travels through one said lane with no target the casino bonus game ends.

11. The casino bonus game of claim 1 wherein when said ball travels through one said lane with no target, then a new ball is propelled.

12. The casino bonus game of claim 1 wherein when said at least one target is hit, then a new ball is propelled.

13. The casino bonus game of claim 1 further comprising:

a credit meter, a ball sensor in each of said lanes;

a controller, said controller in response to said initiate condition occurring (1) randomly displaying said at least one target in said display, (2) activating said launch mechanism, (3) receiving a signal from the ball sensor at said lane said ball traveled through, (4) determining whether said at least one target is hit, and (5) incrementing said credit meter with a payoff for hitting the target.

14. The casino bonus game of claim 1 wherein said display displays at least one second target of a second type and wherein said game response indication is an end of bonus game indication when said at least one target of the second type is hit.

15. The casino bonus game of claim 1 wherein a second game response indication occurs when said ball travels through said one lane missing said at least one target.

16. The casino bonus game of claim 13 wherein said second game response indication is a replay indication of said casino bonus game.

17. A casino game comprising:

a playing field;

a ball, said ball propelled onto said playing field;

a row of lanes on said playing field, said ball after traversing said playing field traveling through one of said lanes;

a display at said row of lanes on said playing field, said display randomly displaying a plurality of targets;

a ball sensor in each of said lanes;

a controller, said controller randomly displaying said plurality of targets in said display, activating said launch mechanism, receiving a signal from the ball sensor at said lane said ball traveled through, and determining whether a target is hit and issuing a game response indication when said target is hit.

18. A method for playing a bonus casino game comprising:

starting play of the bonus casino game when a bonus condition occurs in an underlying casino game;

randomly displaying a plurality of targets at exit lanes of the bonus casino game;

propelling a ball onto a playing field for said bonus casino game, the ball exiting one of the exit lanes;

determining whether the exit lane the ball traveled through has a target displayed;

issuing a game response indication when a target is determined to be at the aforesaid lane;

randomly displaying a plurality of new targets at the exit lanes in response to issuing a game response indication, propelling another ball onto the playing field, the another ball exiting one of the exit lanes, determining whether the aforesaid one exit lane has a new target, issuing a second game response indication when a new target is determined to be at the aforesaid one exit lane.

19. The method of claim 18 wherein the plurality of new targets is the plurality of targets with the determined target removed.

20. The method of claim 18 wherein the number of the plurality of new targets is different from the number of plurality of targets.

21. The method of claim 18 further comprising:

displaying a set of objects in response to the issuance of a game response indication, receiving an input from a player selecting one of the objects in the set, revealing an award associated with the selected one object.

22. The method of claim 18 further comprising:

displaying a set of objects in response to the issuance of a second game response indication, receiving an input from a player selecting one of the objects in the set, revealing an award associated with the selected one object.

23. A method for playing a bonus casino game comprising:

starting play of the bonus casino game when a bonus condition occurs in an underlying casino game;

randomly displaying a series of single digit numbers at exit lanes of the bonus casino game, one single digit number displayed at each of said exit lanes;

sequentially launching a pre-determined number of balls onto a playing field for said bonus casino game, each of the pre-determined number of balls exiting one of the exit lanes;

determining the displayed random number at the exit lane for each of the pre-determined number balls based upon when the balls exited the lanes;

issuing a game response indication in the form of a number read wherein each number read corresponds to a decimal number placement for a decimal number.

24. The method of claim 23 further comprising the step of:

providing an award based on the maximum number created from the number read.

25. The method of claim 23 further comprising the step of:

providing an award based on the number read.

26. The method of claim 23 wherein at least one graphic symbol is added to the series of numbers, said at least one graphic symbol providing an additional game feature when a launched ball travels through a lane containing the graphic symbol.

27. The method of claim 26 wherein the additional game feature is launching another ball.

28. The method of claim 26 wherein the additional game feature is performing a mathematical operation on the number read.

29. A method for playing a bonus casino game comprising:

starting play of the bonus casino game when a bonus condition occurs in an underlying casino game;

randomly displaying a plurality of numerical award values at exit lanes of the bonus casino game, one of said series of numbers displayed at each of a corresponding number of said exit lanes;

randomly displaying at least one graphic in an exit lane not displaying one of said plurality of numerical award values;

launching a ball onto a playing field for said bonus casino game, the ball exiting one of the exit lanes;

when the ball exits the lane displaying the at least one graphic, then performing a predetermined mathematical operation based on the graphic;

issuing a game response indication based on the predetermined mathematical operation.

30. The method of claim 29 wherein the graphic is an arrow.

31. The method of claim 29 wherein the mathematical operation is a summation.

32. The method of claim 29 wherein the mathematical operation is a summation within a topological area.

33. The method of claim 29 wherein the mathematical operation is a multiplication at a set amount and further comprising launching another ball, the value of the number displayed at the lane the another ball traveled through multiplied by the set amount to form an award.

34. A method for playing a bonus casino game interacting with its underlying casino game comprising:

randomly displaying a game outcome in the underlying casino game, the game outcome based on a plurality of different symbols;

randomly displaying at least one of the plurality of symbols at at least one of the exit lanes of the bonus casino game when a bonus trigger occurs in the underlying casino game;

propelling a ball onto a playing field for the bonus casino game, the ball exiting one of the exit lanes;

determining whether the exit lane the ball traveled through has the at least one symbol displayed;

converting all symbols corresponding to the aforesaid displayed symbol to a wild symbol in the game outcome in response to the aforesaid determining;

paying based upon the game outcome having the converted wild symbols.

35. A method for playing a bonus casino game interacting with its underlying casino game comprising:

randomly displaying a game outcome in the underlying casino game, the game outcome comprising a plurality of different symbols arranged in a plurality of columns;

propelling a ball onto a playing field for the bonus casino game, the ball exiting one of the exit lanes, each lane corresponding to a column in the plurality of columns;

determining the exit lane the ball traveled through and its corresponding column;

converting each of the symbols in the determined corresponding column of the game outcome to wild symbols;

paying based upon the game outcome having the converted wild symbols.

* * * * *